US010613453B2

(12) United States Patent
Kimura et al.

(10) Patent No.: US 10,613,453 B2
(45) Date of Patent: Apr. 7, 2020

(54) TONER CARTRIDGE AND TONER SUPPLYING MECHANISM

(71) Applicant: CANON KABUSHIKI KAISHA, Tokyo (JP)

(72) Inventors: Takashi Kimura, Tokyo (JP); Hisayoshi Kojima, Mishima (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/362,859

(22) Filed: Mar. 25, 2019

(65) Prior Publication Data

US 2019/0219947 A1 Jul. 18, 2019

Related U.S. Application Data

(63) Continuation of application No. PCT/JP2017/036049, filed on Sep. 27, 2017.

(30) Foreign Application Priority Data

Sep. 30, 2016 (JP) ..... 2016-192720

(51) Int. Cl.
*G03G 15/08* (2006.01)
*G03G 21/16* (2006.01)

(52) U.S. Cl.
CPC ..... *G03G 15/0886* (2013.01); *G03G 15/0872* (2013.01); *G03G 21/16* (2013.01);
(Continued)

(58) Field of Classification Search
CPC ..... G03G 15/0886; G03G 15/0872; G03G 21/16; G03G 2221/1657; G03G 2215/0877; G03G 2215/067
See application file for complete search history.

(56) References Cited

U.S. PATENT DOCUMENTS 5,235,383 A 8/1993 Tada et al.
5,414,493 A 5/1995 Fujii et al.
(Continued)

FOREIGN PATENT DOCUMENTS

JP H07-199623 A 8/1995
JP 2001-005272 A 1/2001
(Continued)

OTHER PUBLICATIONS

International Search Report and Written Opinion for International Patent Application No. PCT/JP2017/0036049, dated Dec. 12, 2017.
(Continued)

*Primary Examiner* — Hoang X Ngo
(74) *Attorney, Agent, or Firm* — Venable LLP

(57) ABSTRACT

To develop a conventional structure of a toner cartridge. The toner cartridge includes a container and an open/close member. The container includes an accommodating portion for accommodating toner, and a discharge opening. The open/close member includes a closing portion for closing the discharge opening, and a closing force receiving portion. The open/close member a movable relative to the container between a closing position for causing the closing portion to the close the discharge opening and an opening position for causing the closing portion to open the discharge opening. The open/close member including a leading end portion and a trailing end portion which are on downstream and upstream sides of the open/close member with respect to a closing direction in which the open/close member moves to close the discharge opening, respectively. An open/close member extends from the leading end portion to the trailing end portion in a range exceeding 180° of a circumference of the container, as the toner cartridge is seen in the longitudinal direction of the container. The closing force receiving portion receives a force for moving the open/close member from the opening position to the closing position when the toner cartridge is dismounted from the receiving apparatus.

16 Claims, 17 Drawing Sheets

(52) U.S. Cl.
CPC ..... *G03G 2215/067* (2013.01); *G03G 2215/0877* (2013.01); *G03G 2221/1657* (2013.01)

(56) References Cited

U.S. PATENT DOCUMENTS

| | | | | |
|---|---|---|---|---|
| 5,429,026 | A | 7/1995 | Kimura et al. | |
| 5,442,421 | A | 8/1995 | Kojima | |
| 5,471,284 | A | 11/1995 | Fujii et al. | |
| 5,497,220 | A | 3/1996 | Inomata et al. | |
| 5,521,693 | A | 5/1996 | Kojima et al. | |
| 5,528,343 | A | 6/1996 | Tada et al. | |
| 5,548,384 | A | 8/1996 | Weed | |
| 5,579,101 | A | 11/1996 | Omata et al. | |
| 5,940,657 | A | 8/1999 | Yokomori et al. | |
| 5,950,049 | A | 9/1999 | Yokomori et al. | |
| 5,963,759 | A | 10/1999 | Kojima et al. | |
| 5,991,571 | A | 11/1999 | Yamada et al. | |
| 6,072,969 | A | 6/2000 | Yokomori et al. | |
| 6,131,011 | A | 10/2000 | Kojima et al. | |
| 6,157,792 | A | 12/2000 | Mori et al. | |
| 6,178,301 | B1 | 1/2001 | Kojima et al. | |
| 6,185,401 | B1 * | 2/2001 | Kanamori ..... | G03G 15/0872 399/119 |
| 6,266,503 | B1 | 7/2001 | Murayama et al. | |
| 6,289,189 | B1 | 9/2001 | Numagami et al. | |
| 6,314,266 | B1 | 11/2001 | Murayama et al. | |
| 6,345,164 | B1 | 2/2002 | Yokomori et al. | |
| 6,400,916 | B1 | 6/2002 | Go et al. | |
| 6,404,996 | B1 | 6/2002 | Mori et al. | |
| 6,442,359 | B1 | 8/2002 | Numagami et al. | |
| 6,453,135 | B1 | 9/2002 | Sameshima et al. | |
| 6,463,233 | B2 | 10/2002 | Kojima et al. | |
| 6,564,029 | B2 | 5/2003 | Kojima et al. | |
| 6,577,831 | B1 | 6/2003 | Kojima et al. | |
| 6,608,980 | B2 | 8/2003 | Murayama et al. | |
| 7,738,818 | B2 * | 6/2010 | Murakami ..... | G03G 15/0872 399/258 |
| 7,848,685 | B2 | 12/2010 | Nagashima et al. | |
| 8,320,801 | B2 | 11/2012 | Nagashima et al. | |
| 8,369,753 | B2 | 2/2013 | Nagashima et al. | |
| 8,463,164 | B2 | 6/2013 | Nagashima et al. | |
| 8,509,658 | B2 | 8/2013 | Nagashima et al. | |
| 8,583,001 | B2 | 11/2013 | Kubo et al. | |
| 8,693,926 | B2 | 4/2014 | Nagashima et al. | |
| 9,052,640 | B2 | 6/2015 | Kashiide et al. | |
| 9,213,306 | B2 | 12/2015 | Morioka et al. | |
| 9,256,161 | B2 | 2/2016 | Hayashi et al. | |
| 9,377,714 | B2 | 6/2016 | Nakazawa et al. | |
| 9,429,906 | B2 | 8/2016 | Yoshimura et al. | |
| 9,465,318 | B2 | 10/2016 | Takeuchi et al. | |
| 9,523,942 | B2 | 12/2016 | Takeuchi et al. | |
| 9,541,863 | B2 | 1/2017 | Kashiide et al. | |
| 9,632,451 | B2 | 4/2017 | Hayashi et al. | |
| 9,836,020 | B2 | 12/2017 | Yoshimura et al. | |
| 9,989,892 | B2 | 6/2018 | Takeuchi et al. | |
| 10,166,864 | B1 | 1/2019 | Yoshimura et al. | |
| 2005/0135841 | A1 | 6/2005 | Murakami et al. | |
| 2009/0129813 | A1 | 5/2009 | Nagashima | |
| 2009/0245862 | A1 | 10/2009 | Kawai | |
| 2010/0278564 | A1 | 11/2010 | Nagashima et al. | |
| 2017/0139372 | A1 | 5/2017 | Kashiide et al. | |
| 2017/0261926 | A1 | 9/2017 | Kashiide et al. | |

FOREIGN PATENT DOCUMENTS

| | | | |
|---|---|---|---|
| JP | 2005-107392 | A | 4/2005 |
| JP | 2005-173568 | A | 6/2005 |
| JP | 2009-175759 | A | 8/2009 |
| RU | 2 597 669 | C1 | 9/2016 |

OTHER PUBLICATIONS

English translation of Japanese Patent Application Pub. No. 2005-107392.
English translation of Japanese Patent Application Pub. No. 2001-005272.
Examination Report in Australian Patent Application No. 2017337462, dated Sep. 28, 2019.
May 31, 2018 Office Action in Taiwanese Patent Application No. 106133618.
Co-pending U.S. Appl. No. 16/366,023, filed Mar. 27, 2019.
Decision to Grant in Russian Patent Application No. 2019112673, dated Nov. 11, 2019 (with English translation).
Office Action in Taiwanese Patent Application No. 107145827, dated Sep. 26, 2019.
Examination Report in Canadian Patent Application No. 3,038,785, dated Jan. 14, 2020.
Machine translation of Japanese Patent Application Pub. No. 2001-005272 (application published Jan. 12, 2001).

* cited by examiner (a)

(b)

TONER CARTRIDGE AND TONER SUPPLYING MECHANISM

TECHNICAL FIELD

The present invention relates to a toner cartridge and a toner supplying mechanism for forming an electrophotographic image.

BACKGROUND ART

In an electrophotographic image forming apparatus, there has been known a structure in which elements such as a photosensitive drum and a developing roller as rotatable members contributable to image formation are integrated into a cartridge which is dismountable from a main assembly of an image forming apparatus main assembly (hereinafter, apparatus main assembly).

As one of the structures in which a cartridge is dismountably provided in such an image forming apparatus, there is also known a structure in which a toner cartridge containing toner (developer) to be consumed with image forming operation can be exchanged separately from the photosensitive drum and developing roller.

With such a structure, toner (developer) contained in the toner cartridge is supplied to a developing device including a developing roller and the like through a discharge port. In addition, in order to prevent the toner from leaking to the outside through the discharge port, an opening/closing member such as a shutter for opening and closing the discharge opening is provided.

For example, Japanese Laid-open Patent Application No. 7-199623 discloses a structure in which when a cylindrical toner cartridge (developer supply container) is mounted in the image forming apparatus main assembly, the shutter is opened by rotating the toner cartridge.

SUMMARY OF THE INVENTION

Problems to be Solved by Invention

The object of the present invention is to develop the aforementioned prior art.

Means for Solving the Problem

A representative structure according to the present application is a toner cartridge detachably mountable to a receiving apparatus, said receiving apparatus including a toner receiving opening, a closing force applying portion, said toner cartridge comprising (1) a container including (1-1) an accommodating portion for accommodating toner, and (1-2) a discharge opening for discharging the toner from said accommodating portion; (2) an open/close member including (2-1) for closing said discharge opening, and (2-2) a closing force receiving portion, said open/close member and being movable relative to said container between a closing position for causing said closing portion to close said discharge opening and an opening position for causing said closing portion to open said discharge opening, wherein said open/close member including a leading end portion and a trailing end portion which are on downstream and upstream sides of said open/close member with respect to a closing direction in which said open/close member moves to close said discharge opening, respectively, and wherein said open/close member extends from the leading end portion to the trailing end portion in a range exceeding 180 degrees of a circumference of said container, as said toner cartridge is seen in the longitudinal direction of said container, wherein said closing force receiving portion is configured to receive a force for moving said open/close member from the opening position to the closing position when said toner cartridge is dismounted from said receiving apparatus.

Effect of the Invention

The above-mentioned conventional technique can be developed.

DESCRIPTION OF THE EMBODIMENTS

An image forming apparatus for forming an electrophotographic image, a toner image forming portion and a toner cartridge will be described in conjunction with the accompanying drawings. Here, an image forming apparatus forms an image on a recording material by using, for example, an electrophotographic image forming process. For example, it includes an electrophotographic copying machine, an electrophotographic printer (e.g. an LED printer, a laser beam printer and so on), an electrophotographic facsimile machine, and so on).

Here, in the following embodiments, a monochromatic image forming apparatus provided with one toner image forming portion is exemplified. However, the number of toner image forming portions provided in the image forming apparatus is not limited to one. For example, the image forming apparatus may include a plurality of toner image forming portions to form a color image.

Similarly, in each structure disclosed in the embodiment, materials, arrangements, dimensions, other numerical values, and so on are not limited to examples of disclosure, unless limited specifically. In addition, unless otherwise specified, "above" means upward in the direction of gravity when the image forming apparatus is installed.

Embodiment 1

In this embodiment, a structure that contributes to improvement of usability will be described in detail. More specifically, this embodiment relates to improvement of operation feeling when the user mounts the toner cartridge to the developing unit.

First, the structure of the entire image forming apparatus will be described, and then the developing unit and the toner cartridge will be described in detail. Here, the operation of mounting the toner cartridge to the developing unit is referred to as mounting operation, and the operation of removing the toner cartridge from the developing unit is called a dismounting operation.

In addition, the position at which a projection, a hole, and so on are engaged with each other is referred to as the engagement position, and the position at which the engagement is released is referred to as the non-engagement position (disengagement position).

[Electrophotographic Image Forming Apparatus]

Figure 2:
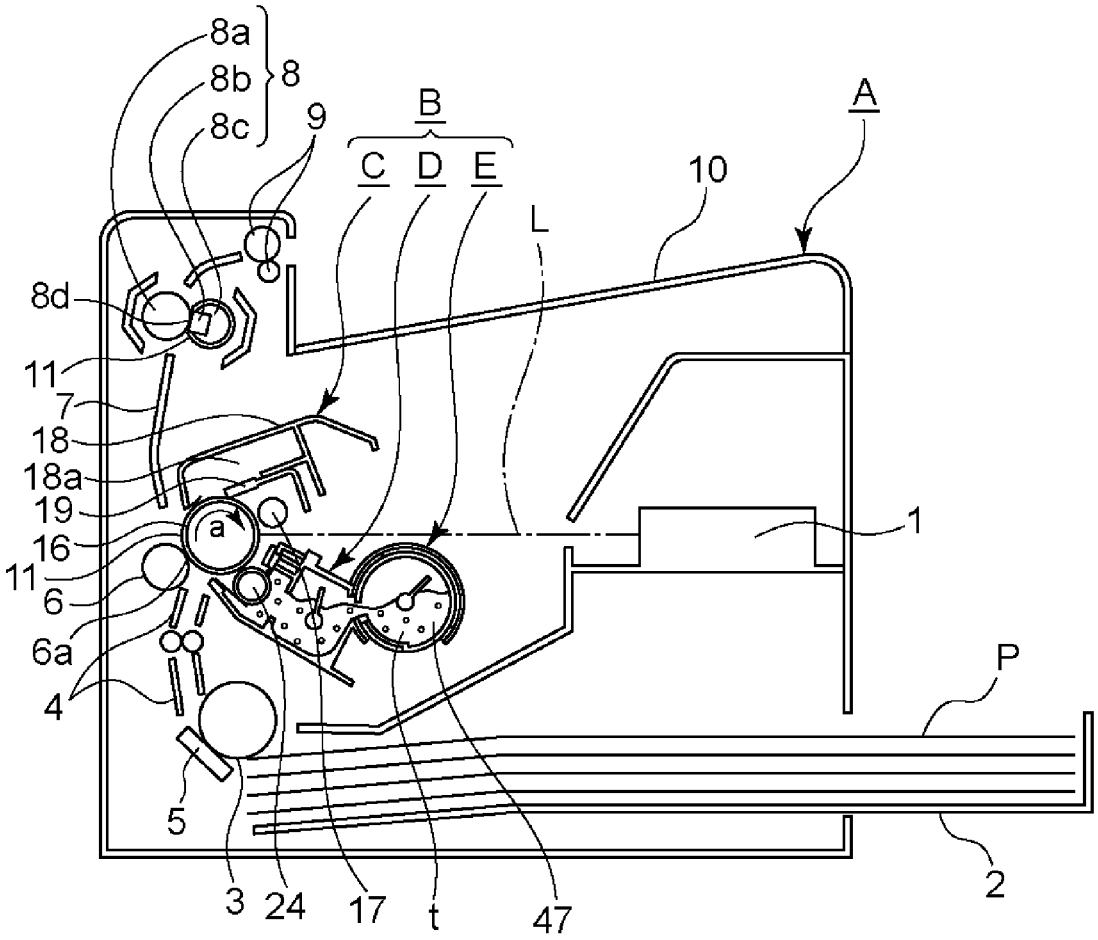
FIG. 2 is a schematic sectional view illustrating a schematic structure of the image forming apparatus according to the embodiment.

FIG. 2 is a side sectional view illustrating the structure of the image forming apparatus A according to this embodiment. The image forming apparatus A shown in FIG. 2 receives image information from an external device such as a personal computer which is communicatably connected therewith. And, in accordance with the received image information, the image forming apparatus A forms an image (toner image) by a developer (toner) on a recording material P (for example, recording sheet, OHP sheet, cloth, and so on) by an electrophotographic image forming process.

In the image forming apparatus A, the toner image forming portion (toner image forming unit) B is mountable to the apparatus main assembly. The toner image forming portion (toner image forming unit) B of this embodiment includes a drum unit C, a developing unit (developing device) D, and a toner cartridge E. The toner cartridge E can be mounted to and dismounted from the developing unit D. That is, the developing unit D includes a mounting portion for mounting the toner cartridge E, and is a receiving device (receiving device) for receiving the toner cartridge E.

Here, the toner image forming portion (toner image forming unit) B can be regarded as a unit including the photosensitive drum and elements acting on the photosensitive drum.

The drum unit C and the developing unit D are integrated into one cartridge, which can be dismountably mounted to the main assembly of the image forming apparatus. A cartridge in which the drum unit C and the developing unit D are integrated is sometimes called a process cartridge in particular. That is, the toner cartridge E is mounted to and dismounted from the developing unit D of the process cartridge. In this case, the entire process cartridge can also be regarded as is receiving apparatus.

In addition, with the toner cartridge E mounted on the developing unit D, the process cartridge is mountable to and dismountable from the apparatus main assembly. That is, the drum unit C, the developing unit D, and the toner cartridge E are mountable to and dismountable from the apparatus main assembly in an integrated state. Therefore, a toner image forming unit (toner image forming unit) B including all of the drum unit C, the developing unit D, and the toner cartridge E may be referred to as a process cartridge.

Here, the drum unit C, the developing unit D, and the toner cartridge E may be in the early formed into cartridges in some cases. In this case, the drum unit C may be referred to as a drum cartridge, and the developing unit D may be referred to as a developer cartridge. In addition, in some cases, the photosensitive drum (or the drum unit including the photosensitive drum) is fixed to the main assembly of the apparatus, and only the developing unit (developing cartridge) D and the toner cartridge E are mountable and dismountable.

In addition, the photosensitive drum and/or the developing unit may be fixed to the apparatus main assembly and only the toner cartridge E may be dismountably mounted to the apparatus main assembly. In this case, the image forming apparatus itself can be regarded as a receiving apparatus for the toner cartridge E.

In addition, the components including the receiving apparatus (developing unit D) and the toner cartridge E may be referred to as a toner supply mechanism (toner supply unit, toner supply device) or the like. In the toner supply mechanism, the toner is supplied (replenished) from the toner cartridge E to the receiving apparatus.

Here, in this example, a photosensitive drum as an image bearing member has a structure in which a flange or the like is integrally mounted to a cylinder including a photosensitive layer.

Mounting and dismounting of each cartridge is carried out by the user (operator, user). In addition, the main assembly of the apparatus (main assembly of the image forming apparatus) refers to the structure portion excluding each cartridge (drum unit C, developing unit D, and toner cartridge E) from the image forming apparatus A.

The drum unit C is a unit in which a photosensitive drum (image bearing member) 16, a charging roller 17, a cleaning blade 19 and the like are integrally unitized, and in this embodiment, it is a cartridge (drum cartridge) mountable to and dismountable from the apparatus main assembly. In addition, the developing unit D is a unit in which a developing roller (developer carrying member) 24 and the like are integrated as a unit, and in this embodiment, it is a portion of a cartridge mountable to a dismountable from the main assembly of the apparatus. The toner cartridge E is a cartridge in which a toner container (developer container, container) 47 and the like for containing the toner t as a developer are integrally formed as a cartridge.

The photosensitive drum 16 rotates in the direction of the arrow a shown in FIG. 2. The surface of the rotating photosensitive drum 16 is uniformly charged by charging roller 17 as charging means. The laser beam L corresponding to image information is irradiated from the laser scanner (exposure means) 1 onto the photosensitive drum 16, so that an electrostatic latent image corresponding to the image information is formed on the photosensitive drum 16. And, the toner t carried on the developing roller 24 develops the electrostatic latent image. By this, a toner image is formed on the photosensitive drum 16.

Figure 3:
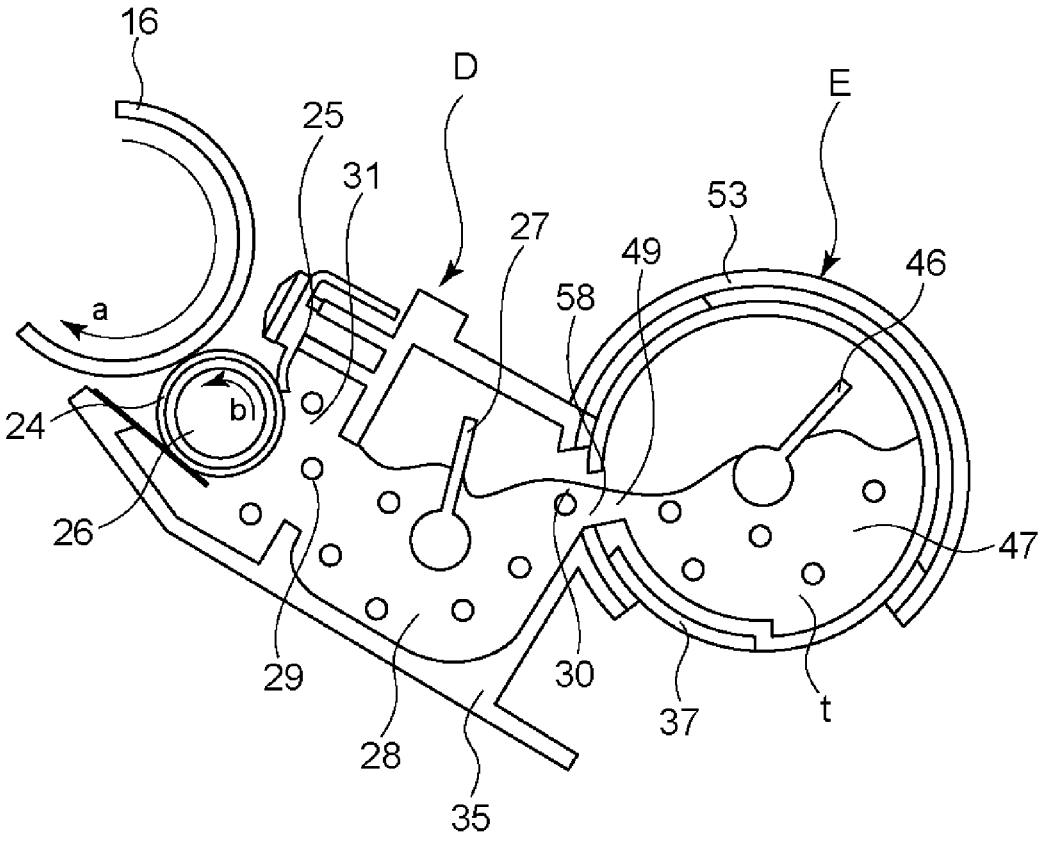
FIG. 3 is a schematic side sectional view of a state in which the toner cartridge is mounted on the developing unit.

Here, referring to FIG. 3, a development process in the toner image forming portion B will be explained. A frame 35 of the developing unit D as the receiving apparatus rotatably supports the developing roller 24. The developing roller 24 receives a driving force from a power source such as a motor (not shown) provided in the main assembly of the apparatus and is rotationally driven in the forward direction (the direction of an arrow b in the Figure) with respect to the photosensitive drum 16.

The toner tin the developing chamber 31 is carried on the peripheral surface of the developing roller 24 with its layer thickness regulated by the developing blade 25. When layer thickness is regulated, electric charge is applied to the toner by triboelectrical charging. And, the charged toner develops the electrostatic latent image on the photosensitive drum 16.

In the developing unit D, the developing chamber 31 communicates with the first toner containing portion (developer accommodating portion) 28 through the first opening portion 29. A first toner feeding means 27 which is rotationally driven by a driving source (not shown) supplies the toner t from a first toner containing portion 28 to the developing chamber 31.

In addition, a communicating portion 58 is formed by a second opening portion (containing body opening, receiving port, receiving opening) 30 and a third opening portion (container opening, discharge port, discharge opening) 49. Through this communication portion 58, the first toner containing portion (containing member accommodating chamber) 28 communicates with a second toner containing portion (container accommodating chamber) 47*t* of the toner cartridge E.

A second toner container 47*t* contains toner, and therefore, it is a space provided inside the container 47. The second toner storing portion 47*t* is a storing portion (toner storing portion, developer storing portion) formed by the frame (container frame 47*a*) of the container 47.

A third opening portion 49 is formed in the container frame 47*a* and is a discharge opening for discharging the toner from the second toner containing portion 47*t* to the outside of the toner container 47 (that is, the developing unit D). The toner discharged from the third opening portion 49 is received in the second opening (receiving port) 30 of the developing unit D.

In the first toner containing portion 28, the toner t is supplied from the second toner containing portion 47*t* by a second toner feeding member 46 which is rotated by the driving force inputted from the main assembly of the apparatus by way of the developing unit D.

Referring back to FIG. 2, the description will be further made. The recording material P set in the feeding cassette 2 is separated and fed one by one by the pickup roller 3 and the pressure contact member 5 pressed against the pickup roller 3. And, in synchronization with the toner image formed on the photosensitive drum, the recording material P is fed along the feeding guide 4 to the transfer roller 6 as a transfer means.

Next, the recording material P passes through the transfer nip portion 11 formed by the photosensitive drum 16 and the transfer roller 6 which is supplied with a constant voltage is applied. At this time, the toner image formed on the photosensitive drum 16 is transferred onto the recording material P. The recording material P on which the toner image is transferred is fed to the fixing means 8 by a feeding guide 7.

The fixing means 8 includes a driving roller 8*a* and a fixing roller 8*c* incorporating a heater 8*b*. The recording material P is subjected to heat and pressure when passing through the nip portion 8*d* formed between the fixing roller 8*c* and the driving roller 8*a*. By this, the toner image transferred onto the recording material P is fixed on the recording material P. Thereafter, the recording material P on which the toner image has been fixed is fed by the pair of discharge rollers 9 and is discharged to a discharge tray 10.

The cleaning blade 19 is elastically contacted to the outer peripheral surface of the photosensitive drum 16. By this, the toner t (untransferred residual toner) remaining on the photosensitive drum 16 that has not been transferred onto the recording material P is scraped off by the cleaning blade 19. The scraped toner t is stored in the removed toner containing portion (waste toner containing portion) 18*a* of the frame 18 to which the cleaning blade 19 is fixed.

As described in the foregoing, in the image forming apparatus of this embodiment, an image is formed on a recording material (recording material) with the developer (toner) through an electrophotographic image forming method. Naturally, it is satisfactorily to form an image on the recording material as an image forming apparatus and therefore, an electrophotographic copying machine, an electrophotographic printer (a laser beam printer, a LED printer, and so on), an electrophotographic facsimile machine, an electrophotographic word processor, and the like are usable, and the form thereof is not limited.

As described in the foregoing, the toner image forming portion B includes an electrophotographic photosensitive member (photosensitive member) which is an image bearing member and a process means actable on the photosensitive member. In this embodiment, the toner image forming portion can be dismountably mounted to the main assembly of the image forming apparatus as one or more cartridges.

The process means includes charging means (charging member, charging device), developing means (developing device, developing unit), cleaning means (cleaning device, cleaning member), and the like.

A developing device is a device used for developing the electrostatic latent image formed on a photosensitive member. In this embodiment, the developing device (developing unit) is formed into a cartridge and can be dismounted from the image forming apparatus as a unit. On the other hand, the developing device may constitute a portion of the process cartridge.

In addition, a toner cartridge (a developer cartridge, a toner bottle, a developer bottle, a toner container, a developer container) is a cartridge containing a developer (toner) used for developing the electrostatic latent image formed on the photosensitive member.

[Structure of Each Cartridge (Each Unit)]

A detailed structure of each cartridge (each unit) dismountably provided in the image forming apparatus will be described.

(Details of Neighborhood of Toner Cartridge Receiving Portion of Developing Unit)

Figure 4:
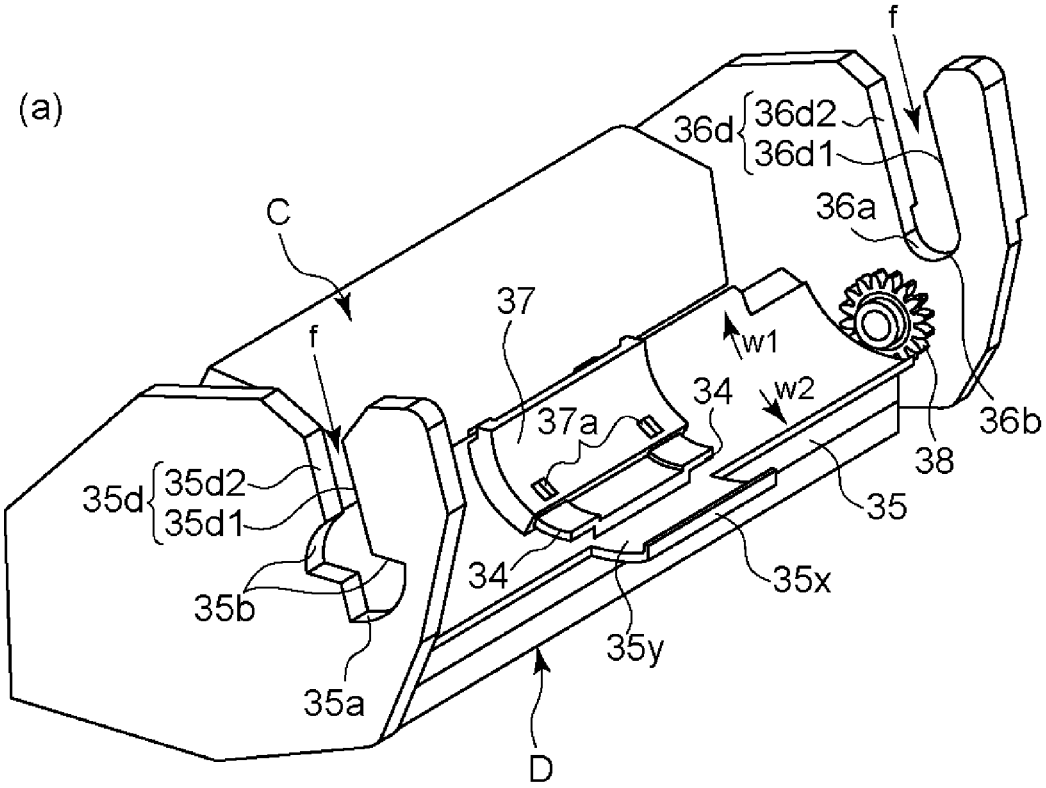
FIG. 4 is a schematic perspective view of the developing unit according to the embodiment.
Figure 4:
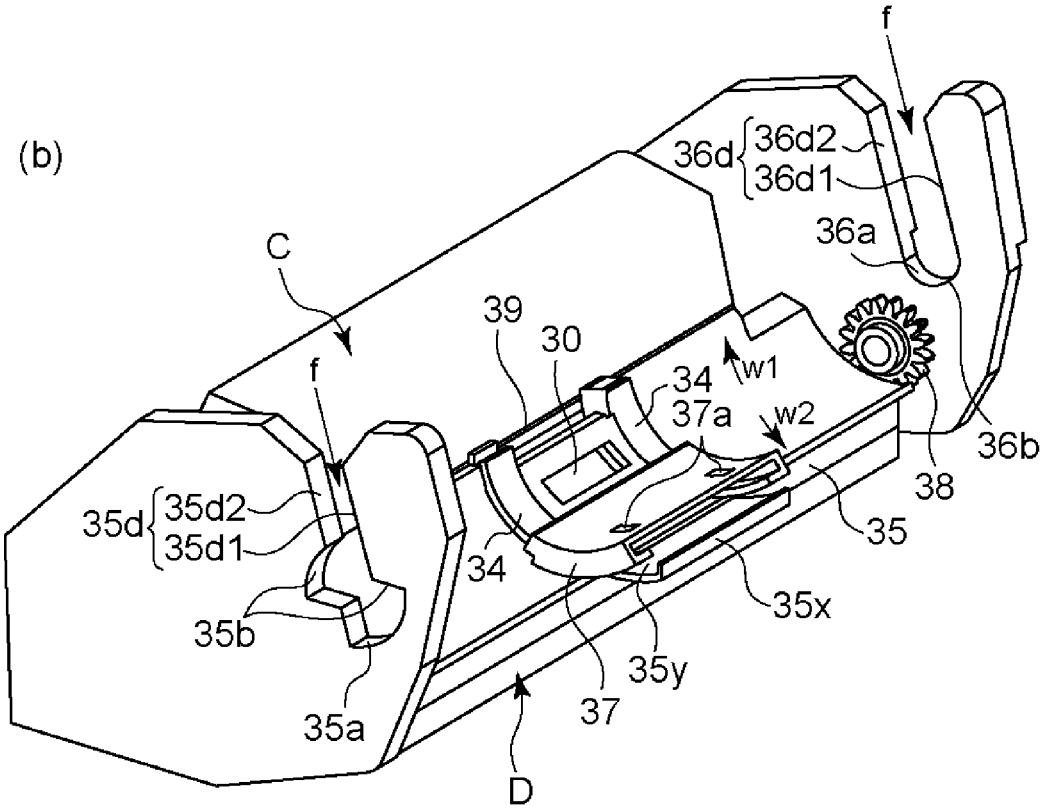

Referring to FIG. 4, a detailed structure of the neighborhood of the receiving portion of the toner cartridge E of the developing unit D according to this embodiment will be described. FIG. 4 is a perspective view of the neighborhood of the receiving portion (mounting portion) of the toner cartridge E of the developing unit D. Part (a) of FIG. 4 shows a state in which the second opening portion 30 is closed (the first shutter 37 is in the closing position). In addition, part (b) of FIG. 4 illustrates a state in which the second opening portion 30 is open (the first shutter 37 is in the open position). In this example, the longitudinal direction of the developing unit D is a direction parallel to the rotational axis direction of the developing roller 24 of the developing unit D. Here, in a state in which the toner cartridge E is mounted to the developing unit, the longitudinal direction of the toner cartridge E is substantially parallel to the longitudinal direction of the developing unit D.

In the developing unit D, and the toner cartridge E can be mounted (or dismounted) to the frame (developing frame) 35. In the neighborhood of the receiving portion, the developing unit D has the second opening (containing body opening, receiving port) 30 and the first shutter (containing body shutter, receiving apparatus side shutter, receiving apparatus side opening/closing member) 37. In this embodiment, the second opening portion 30 is provided in the central portion in the longitudinal direction of the developing unit D. However, the position of the second opening portion 30 is not limited to the central portion in the longitudinal direction as long as it faces the third opening (container opening) 49 which will be described hereinafter.

As shown in part (a) of FIG. 4, the second opening portion 30 is sealed by a first shutter 37 including a shape having a curvature along the outer peripheral surface of the toner cartridge E.

The first shutter 37 has a hole portion 37*a* which is engaged with a projection (a container side engaging portion, an opening/closing member moving portion, a container side projection) 45 provided in the toner cartridge E as a developer container. Two such projections 45 and two such hole portions 37 are provided. This hole portion 37*a* is provided outside the sealed area where the first shutter 37 seals the second opening portion 30.

In addition, the end portions, in the longitudinal direction, of the first shutter 37 are engaged with a first shutter guide portions 34 provided on the respective sides, in the longitudinal direction, of the second opening portion 30 in the frame 35 of the developing unit D. By this, the first shutter is constituted to be slidable (movable) along the first shutter guide portion 34 (the directions of arrows W1 and W2).

By doing so, the first shutter 37 is movable between the closing position for closing the second opening portion 30 (the receiving opening closing position, part (a) of FIG. 4) and the open position (the receiving port opening position, part (b) of FIG. 4) for opening the second opening portion 30.

In addition, the developing unit D is provided with a toner receiving portion (closing force applying portion) 35*x* and a toner receiving portion 35*y* below the gravity direction g of the second opening portion 30 (part (b) of FIG. 4) in order not to let the toner t leaking through the second opening portion 30 fall from the developing unit D. The toner receiving portion 35*y* is a surface covered with the first shutter 37 taking the open position (part (a) of FIG. 4). The toner receiving portion 35*x* is a projection provided at the end portion of the toner receiving portion 35*y* and extends in the longitudinal direction.

In this example, the arrangement of the toner receiving portions 35*x* and 35*y* in the longitudinal direction is such that they are outward of the second opening portion 30 in the longitudinal direction and outward of the hole portion 37*a* in the longitudinal direction (not shown). However, the arrangement of the toner receiving portions 35*x* and 35*y* in the longitudinal direction is not limited to this example. However, from the standpoint not to let the toner t leaking through the second opening portion 30 fall from the cartridge. It is preferable to extends it to a region outside the second opening portion 30 with respect to the longitudinal direction.

Even if toner leaks from the second opening portion 30 when the first shutter 37 moves, the toner can be kept on the toner receiving portion 35*y* and the toner receiving portion 35*x*. This suppresses toner from entering the main assembly of the apparatus from the cartridge.

In addition, as shown in part (b) of FIG. 4, a first sealing seal 32 for sealing the gap between the first shutter 37 and the second opening portion 30 is mounted to the frame 35 of the developing unit D so as to surround the second opening portion 30.

The developing unit D is provided at opposite longitudinal ends with insertion guide portions (receiving apparatus side guides) 35*d*, 36*d* for guiding the toner cartridge E while maintaining the attitude (mounting attitude) of the toner cartridge when mounting (inserting) the toner cartridge E into the frame 35.

In addition, the developing unit D is provided with an abutted portions 35*a*, 36*a* against which the abutting portions 42*a*, 43*a* of the toner cartridge E abut when the toner cartridge E is inserted, as will be described hereinafter.

Furthermore, the developing unit D has rotation guide portions 35*b*, 36*b* for guiding the rotation of the toner cartridge E at opposite longitudinal ends of the frame 35 when opening and closing the first shutter 37 and the second shutter (container shutter) 53.

The insertion guide portions 35*d*, 36*d* linearly extend parallel to each other along the inserting direction f (part (a) of FIG. 4) of the toner cartridge E. Here, a direction opposite to the inserting direction of the toner cartridge E is sometimes referred to as a removal direction (a direction to removing the toner cartridge E from the development unit D) in some cases. In this case, the downstream side in the inserting direction can be regarded as the upstream side in the removal direction, and the insertion upstream side can be regarded as the downstream side in the removal direction.

In the developing unit D, the abutted portion 35*a* and the rotation guide portion 35*b* are provided on the downstream side, in the inserting direction f, of the insertion guide portion 35*d* on the non-driving side at the drive side, and the abutted portion 36*a* and the rotation guide 36*b* are provided on the downstream side, in the inserting direction f, of the insertion guide portion 36*d*.

Here, regarding the opposite end sides in the longitudinal direction of the developing portion D, the side on which a drive portion such as a gear (e.g. The first drive transmission portion 38) is disposed is hereinafter referred to as the drive side. The non-driving side of the developing unit is opposite to the driving side in the longitudinal direction.

Furthermore, the first drive transmission portion 38 for transmitting the drive to the second toner feeding means 46 of the toner cartridge E which will be described hereinafter is provided at one end, in the longitudinal direction, of the frame 35 of the developing unit D.

The first drive transmission portion 38 is a gear and is connected to the drive mechanism of the image forming apparatus main assembly inside the development unit D. The first drive transmission portion 38 is a torque transmission portion (drive force transmission portion) for transmitting the rotational force for driving the second toner feeding member 46 from the outside of the toner cartridge E.

(Detailed Description of Toner Cartridge)

Figure 5:
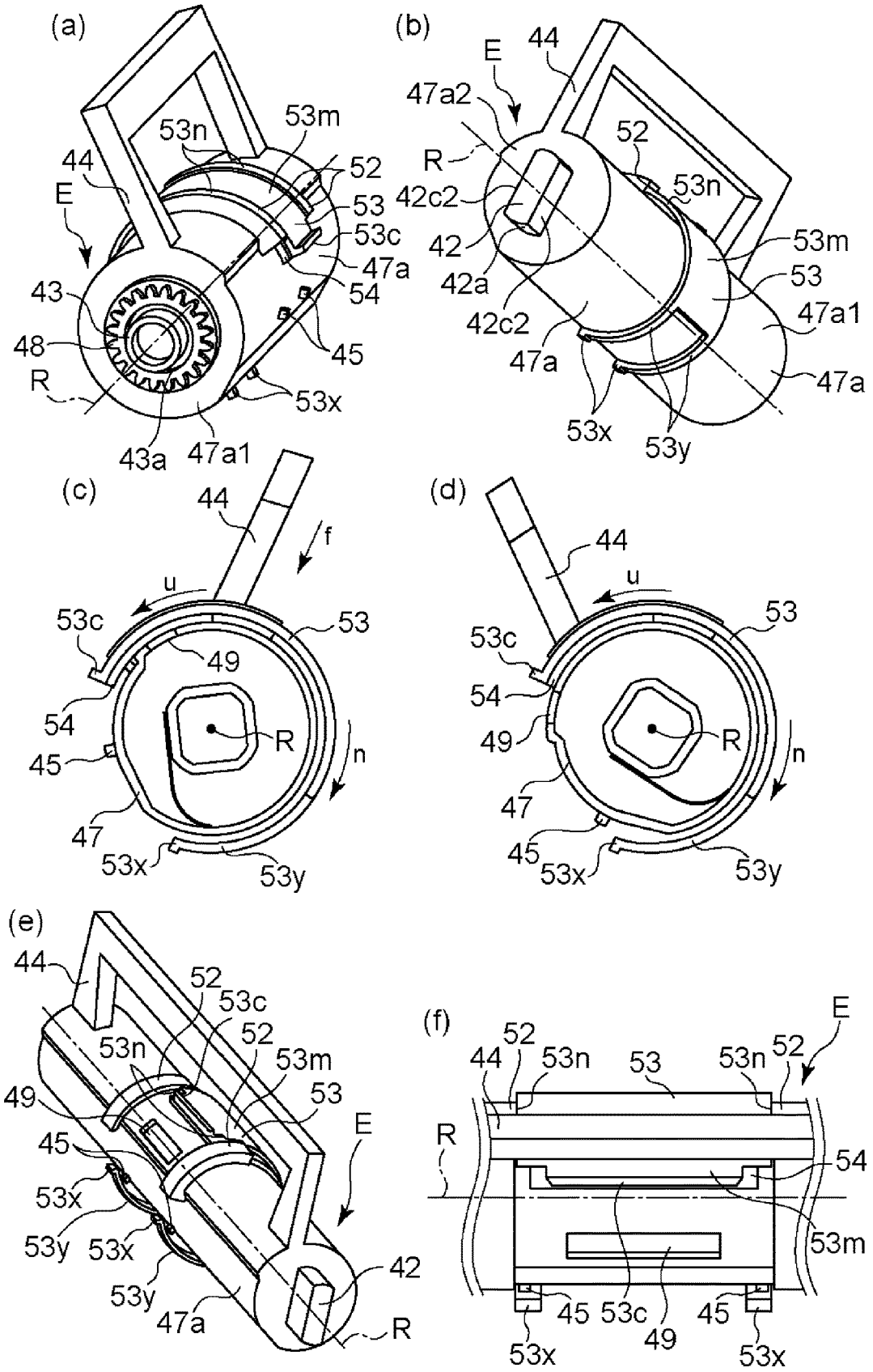
FIG. 5 is a schematic view of the toner cartridge according to the embodiment.

Referring to FIG. 5, a detailed structure of the toner cartridge E according to this embodiment will be described.

Part (a) of FIG. 5 is a perspective view of the toner cartridge E as viewed from the second drive transmission portion 48 side (drive side). In addition, part (b) of FIG. 5 is a perspective view in a state where the second shutter 53 closes the third opening portion 49 as the toner cartridge E is viewed from the side opposite to the second drive transmission portion 48 side (non-drive side). Part (c) of FIG. 5 is a sectional view of the toner cartridge E in the closed state of the third opening portion 49 as viewed from the side opposite to the side of the second drive transmission portion 48. In addition, part (d) of FIG. 5 is a sectional view of the toner cartridge E in the state where the third opening portion 49 is opened as viewed from the side opposite to the side of the second drive transmission portion 48. And, part (e) of FIG. 5 is a perspective view of the second shutter 53 of the toner cartridge E when it is in the open position (state in which the third opening portion 49 is open). Part (f) of FIG. 5 is an enlarged view of the neighborhood of the third opening with the third opening portion 49 in the opened state. Here, in FIG. 5, the toner t is not shown.

The toner cartridge E is provided with the container 47, the second shutter (developer container shutter) 53 movable relative to the container 47, the second toner feeding member 46 provided inside the container 47, the second drive transmission portion (gear) 48 mounted to the second toner feeding member 46, and the like.

The container 47 has a substantially cylindrical shape. That is, the frame (container frame) 47*a* constituting the body portion (main portion) of the container 47 has a substantially cylindrical shape. Here, the longitudinal direction of the toner cartridge E is the longitudinal direction of the cylindrical shape.

An insertion guided portion (guided portion, toner cartridge side guide portion) 42 projecting outward, in the longitudinal direction, of the side wall 47*a*2 of the container frame 47*a* is provided at the end portion. In the longitudinal direction, of the container 47. Similarly, at the other longitudinal end portion of the container 47, an insertion guided portion (guided portion, toner cartridge side guide portion) 43 projecting outward, in the longitudinal direction, of the side wall 47*a*1 of the container frame 47*a* is provided.

In addition, the container 47 has an operating portion 44 to be operated by a user. The operating portion 44 is a U-shaped projection integrally formed with the frame 47*a*. Here, the shape of the operating portion 44 is not limited to the U shape. In addition, the operating portion 44 may be formed integrally with the container frame 47*a*, or may be made of a member different from the frame 47*a* and mounted to the frame 47*a*. The operating portion 44 is a holding portion (grip, gripping section) for the user to grip when inserting or removing the toner cartridge E.

As shown in part (c) of FIG. 5, the container frame (cylindrical portion) 47*a* is hollow and forms a second toner containing portion 47*t* in which the toner t is accommodated. A second toner feeding member 46 for feeding the toner is rotatably provided inside the second toner containing portion 47*t* of the container frame 47*a*. A second drive transmission portion 48 for receiving the power (rotational force, driving force) for rotationally driving the second toner feeding member 46 is provided at one end portion, in the longitudinal direction (rotational axis direction), of the second toner feeding member 46 (part (a) of FIG. 5). The second drive transmission portion 48 is a gear (drive input gear) which receives the driving force (rotational force) from the outside (that is, from the developing unit D as the receiving device) of the toner cartridge E.

Figure 14:
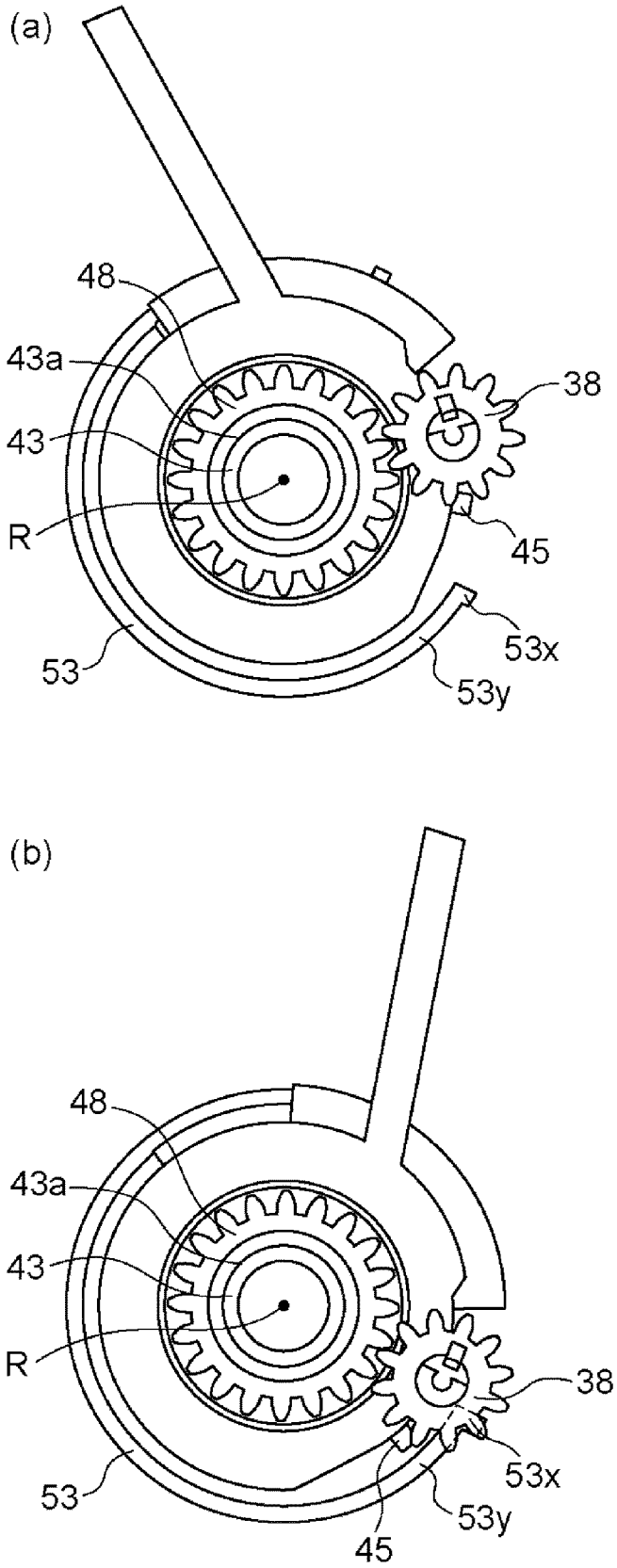
FIG. 14 is a side view of a structure in which a toner cartridge is provided with a drive transmission portion engaged with a second drive transmission portion.

Here, in this embodiment, the driving force is directly transmitted from the second drive transmission portion 48, which is the drive input gear, to the second toner feeding member 46. However, the driving force may be transmitted from the driving input gear to the second toner feeding member 46 via another driving transmission member (for example, one or a plurality of gears). Referring to FIG. 14, such a structure like this will be described hereinafter.

The container frame 47*a* is provided with two projections 45 provided so as to be engageable with the hole portion 37*a* of the first shutter 37, on the outer circumference of its cylindrical shape. The two projections 45 project in substantially the same direction. In the direction of inserting the toner cartridge E into the developing unit D, the projection 45 projects toward the downstream side.

In addition, the line connecting the two projections 45 is substantially parallel to the longitudinal direction of the toner cartridge E. As shown in part (f) of FIG. 5, in the longitudinal direction of the container 47, the two projections 45 are arranged outside the third opening portion 49. To describe it in more detail, when the two projections 45 and the third opening portion 49 are projected onto an imaginary line parallel to the center axis R of the container frame 47*a*, the entire projection area of the third opening portion 49 is positioned within the range sandwiched between the projection areas of the two projections (not shown).

When the second shutter 53 moves from the open position to the closed position, the leading end portion of the second shutter 53 approaches to the two projections 45.

In addition, as shown in part (e) of FIG. 5, a third opening portion 49 for discharging the toner t of the second toner containing portion 47*t* is provided on the peripheral surface of the container frame 47*a*. In this embodiment, the third opening portion 49 is provided on the outer peripheral surface of the container frame 47*a* at the center portion of the toner cartridge E in the longitudinal direction. However, the position of the third opening portion 49 is not limited to a specific position as long as it is a position facing the second opening portion 30.

As shown in part (c) of FIG. 5, a cross-section of the second shutter 53 (a portion perpendicular to the center axis R of the container frame 47*a*) has a curved shape (substantially circular arc shape) extending along the outer circumference of the container frame 47*a*.

The surface of the container frame 47*a* has a curved surface shape (substantially cylindrical shape, substantially circular arc shape) at least around the third opening portion 49. The second shutter 53 can rotate (revolve) around the container frame 47*a* along this curved surface portion (circular arc portion) around the third opening portion 49. By this, the second shutter 53 can open and close the third opening portion 49.

More specifically, in the state in which the third opening portion 49 is opened (part (d) of FIG. 5), the second shutter 53 moves relative to the container frame 47*a* in the direction of arrow u. Then, the third opening portion 49 changes from the open state to the closed state (part (c) in FIG. 5).

In addition, the second shutter 53 includes a shutter body portion 53*m* (body portion, closing portion) for closing the third opening portion 49. Here, the longitudinal direction of the shutter body 53*m* is substantially parallel with the longitudinal direction of the toner cartridge E.

Here, the leading end side of the second shutter 53 is on the downstream side in the direction (arrow u direction) in which the second shutter 53 moves relative to the container frame 47*a* when the second shutter 53 closes the third opening portion 49. The leading end of the second shutter 53 is an end portion (first abutting portion) 53*c* on the downstream side in the arrow u direction in a short side direction of the second shutter 53 (direction perpendicular to the longitudinal direction of the second shutter 53).

In addition, the trailing end side of the second shutter 53 is on the upstream side in the direction (arrow u direction) in which the second shutter 53 moves relative to the container frame 47*a* when the second shutter 53 closes the third opening portion 49. The trailing end of the second shutter 53 is the end portion (second abutting portion) 53*x* on the upstream side, in the arrow u direction in the short side direction, of the second shutter 53 (the direction perpendicular to the longitudinal direction of the second shutter 53).

Figure 13:
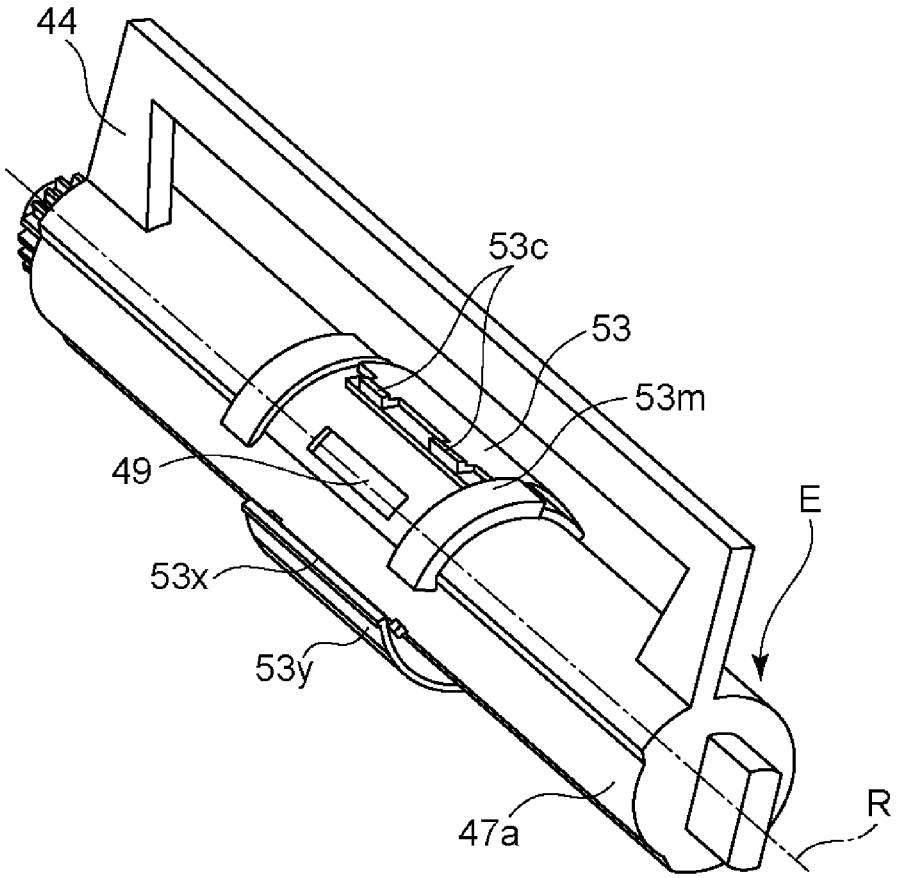
FIG. 13 is a perspective view illustrating a modified example of the structure of the abutting portion of the toner cartridge.

A first abutting portion (opening force receiving portion, engaging portion) 53*c* projecting in the outer circumferential direction of the container frame 47*a* is provided at the leading end portion of the second shutter 53. In this embodiment, the first abutting portion 53*c* is provided at one position in the longitudinal direction center of the shutter body 53*m* of the second shutter 53 (part (f) of FIG. 5), but it is not limited to this structure, and it may be provided at each of two places, as shown in FIG. 13. In addition, the first abutting portion 53*c* is formed integrally with the second shutter 53, but they may be formed as separate members.

An extending portion 53*y* is provided on the trailing end side of the second shutter 53. And, a second abutting portion 53*x* (closing force receiving portion, engaging portion) projecting in the outer peripheral direction of the container frame 47*a* is provided in the neighborhood of the trailing end of the second shutter 53 of the extending portion 53*y*. Here, in the second shutter 53, the angle from the first abutting portion 53*c* to the second abutting portion 53*x* is 180° or more. That is, the second shutter 53 extends from the leading end (first abutting portion 53*c*) to the trailing end (second abutting portion 53*x*) thereof and is placed in a range exceeding 180° around the container frame 47*a*.

That is, as viewing the toner cartridge E along the longitudinal direction thereof, the second shutter 53 covers half or more of the periphery of the container frame 47*a*. With such a structure, the second shutter 53 is difficult to be removed from the container frame 47*a*. It is possible to prevent the second shutter 53 from being dismounted from the container frame 47*a* due to erroneous operation by the user.

Figure 17:
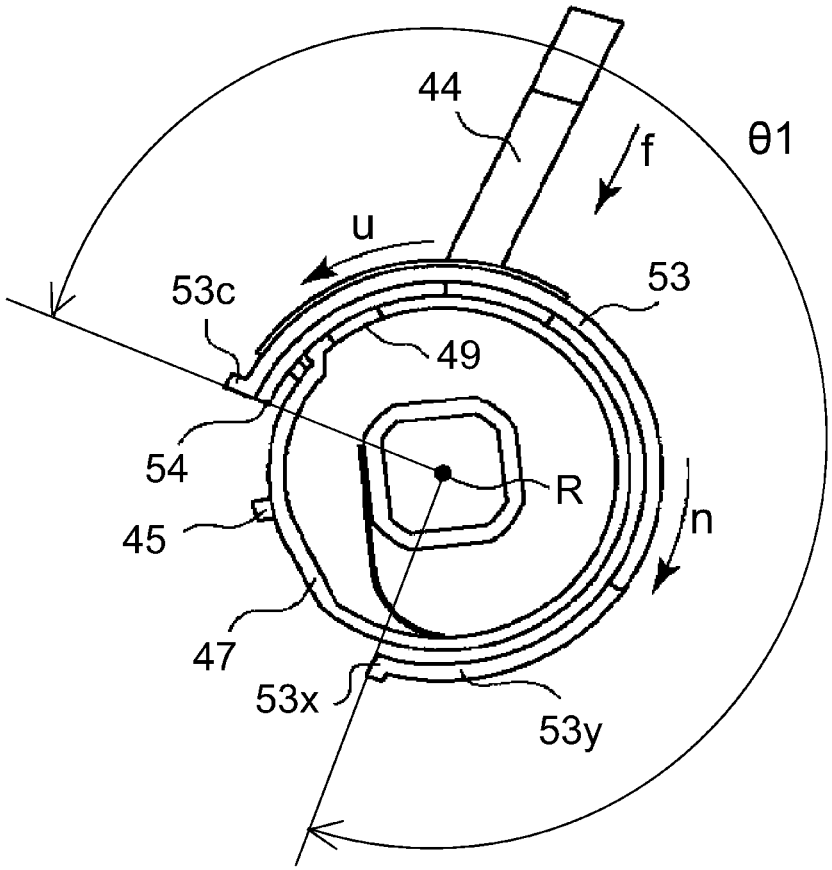
FIG. 17 is an illustration of an arrangement relationship of the second shutters.

Referring to FIG. 17, the arrangement relationship of the second shutter 53 will be described in more detail. The second shutter 53 has been described as being disposed in a range exceeding 180° around the container 47. Angle θ1 shown in FIG. 17 is a angle around the center R of the container frame 47*a* from the front end 53*c* of the second shutter 53 to the trailing end 53*x* thereof. This angle θ1 is larger than 180°. In particular, as the toner cartridge E of this embodiment is viewed along its longitudinal direction, the second shutter 53 is placed in a range of 230° or more around the container frame 47*a*. On the other hand, the area where the second shutter 53 is arranged is set at 270° or less. That is, the angle θ1 is not less than 230° and not more than 270°. At this time, the area range in which the second shutter 53 does not exist is at least 90° around the container frame 47*a*.

Here, the center R of the container 47 as a reference of the angle θ1 is the rotation axis of the container 47. That is, the center R at which the container 47 rotates when opening and closing the second shutter 53 is the reference of the angle θ1. In addition, the frame of the container 47 has a substantially cylindrical shape. The center R of this cylindrical shape is the reference of the angle θ1.

As shown in part (f) of FIG. 5, in the longitudinal direction, a part of the second abutting portion 53*x* is provided more inside than the two projections 45 in the longitudinal direction. To describe it in more detail, as projecting two projections 45 and the second abutting portion 53*x* on an arbitrary imaginary plane parallel to the central axis R of the container frame 47*a* (not shown), a part of the region sandwiched by the second abutting portions 53*x* is located within the range of the region sandwiched by the two projection portions.

Here, the position of the second abutting portion 53*x* is not limited to this structure, and it suffices if there is a region disposed inside of the two projections 45 in the longitudinal direction. In addition, the second abutting portion 53*x* is provided at each of two positions on the shutter body portion 53*m* of the second shutter 53, but, the present invention is not limited to this structure, and one may be provide as shown in FIG. 14.

In addition, in this embodiment, the extending portion 53*y* is formed integrally with the second shutter 53, but they may be formed separately. In addition, the second abutting portion 53*x* is formed integrally with the extending portion 53*y*, but they may be formed as separate members.

As shown in part (c) of FIG. 5, the toner cartridge E is seen along the longitudinal direction. The state in which the second shutter 53 is opened from the state (part (c) in FIG. 5) in which the third opening portion 49 is closed (part (d) in FIG. 5) is obtained. At this time, the two projections 45 are arranged on the side approaching the second abutting portion 53*x* of the second shutter 53.

As shown in part (a) of FIG. 5, the opposite end portions 53*n*, in the longitudinal direction, of the second shutter 53 (shutter body portion 53*m*) are engaged with second shutter guide portions (opening/closing guides) 52 provided on opposite sides, in the longitudinal direction, of the third opening portion 49 of the container frame 47*a*. And, the structure is such that the shutter body portion 53*m* of the second shutter 53 is slidable in the circumferential direction on the outer peripheral surface of the container frame 47*a* along the second shutter guide portion 52. By this, the second shutter 53 is movable between the opening portion (part (d) of FIG. 5) in which the third opening portion 49 is opened, and a second position in which the third opening portion 49 is closed (container closed position, part (c) in FIG. 5) along the outer peripheral surface of the toner cartridge E.

Here, when the second shutter 53 is in the open position, it is preferable that the third opening portion 49 is entirely opened from the shutter body portion 53*m* (closed portion), as shown in part (d) of FIG. 5. However, if the toner t can be discharged by the required amount from the third opening portion 49 when the second shutter 53 is in the open position, it is also possible to employ a structure in which a portion of the third opening portion 49 is covered with the shutter body portion 53*m* (closing portion). That is, any structure may be used as long as when the second shutter 53 is in the open position, the shutter body 53*m* at least partially opens the third opening portion 49, so that the toner t can be supplied from the toner cartridge E to the developing unit D.

In addition, it is preferable that when the second shutter 53 is in the closed position, as shown in part (c) of FIG. 5, the entirety of the third opening portion 49 are covered by the shutter body 53*m*. However, the third opening portion 49 may be slightly opened provided that the third opening portion 49 is substantially closed by the shutter body portion 53*m* and the toner is sufficiently suppressed from leaking out through the third opening portion 49. That is, it will suffice if the shutter body 53*m* substantially closes the third opening portion 49 when the second shutter 53 is in the closing position.

[Mounting of Toner Cartridge to Developing Unit]

Next, the process of mounting the toner cartridge E to the developing unit D will be described. More specifically, by rotating the toner cartridge E with the toner cartridge E inserted into the developing unit D, the second opening portion 30 and the third opening portion 49 are opened and closed.

(Inserting Operation of Toner Cartridge into Developing Unit)

Figure 1:
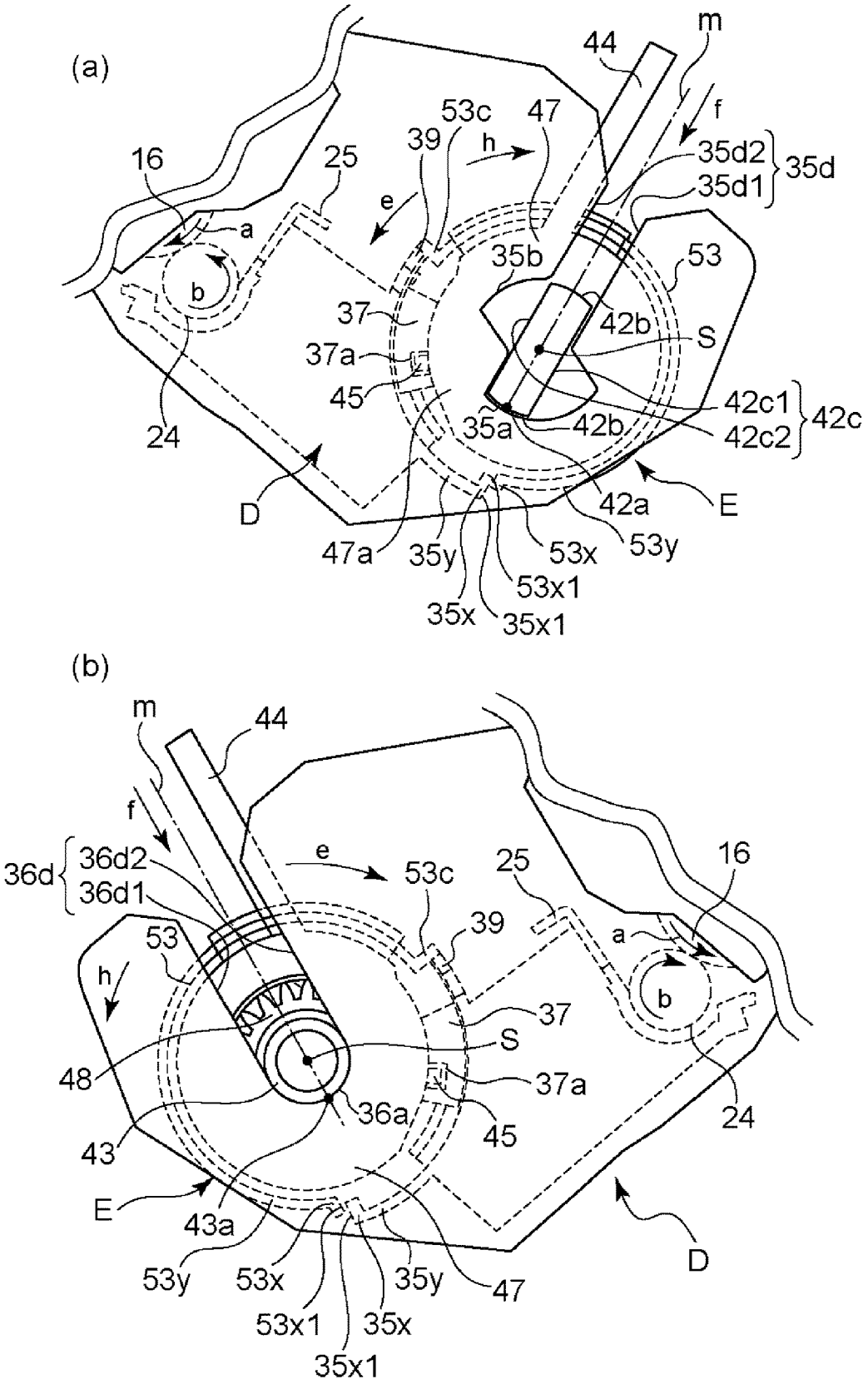
FIG. 1 is a side view of a toner cartridge according to an embodiment.
Figure 6:
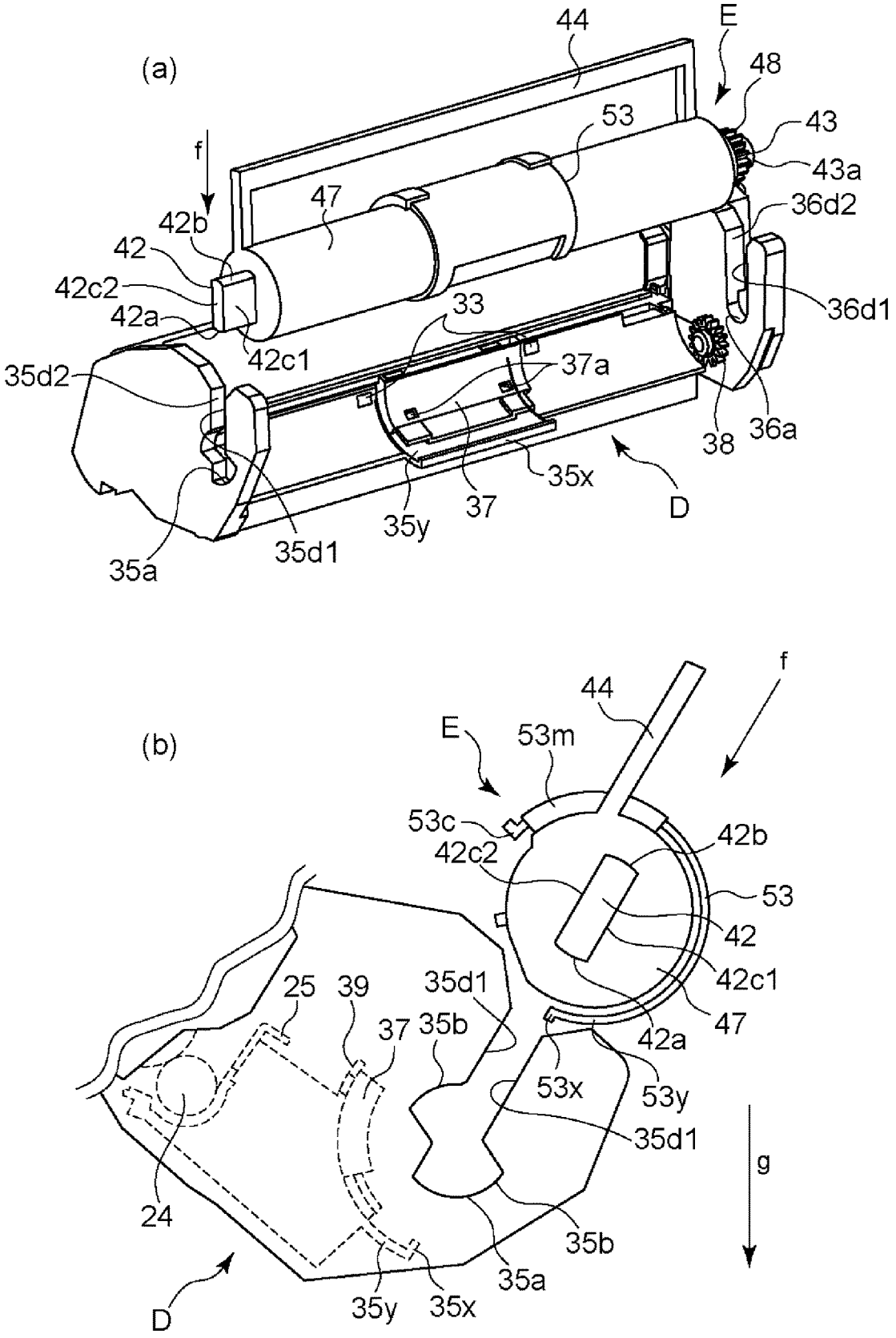
FIG. 6 is a schematic illustration of a developing unit and a toner cartridge before mounting (insertion).
Figure 7:
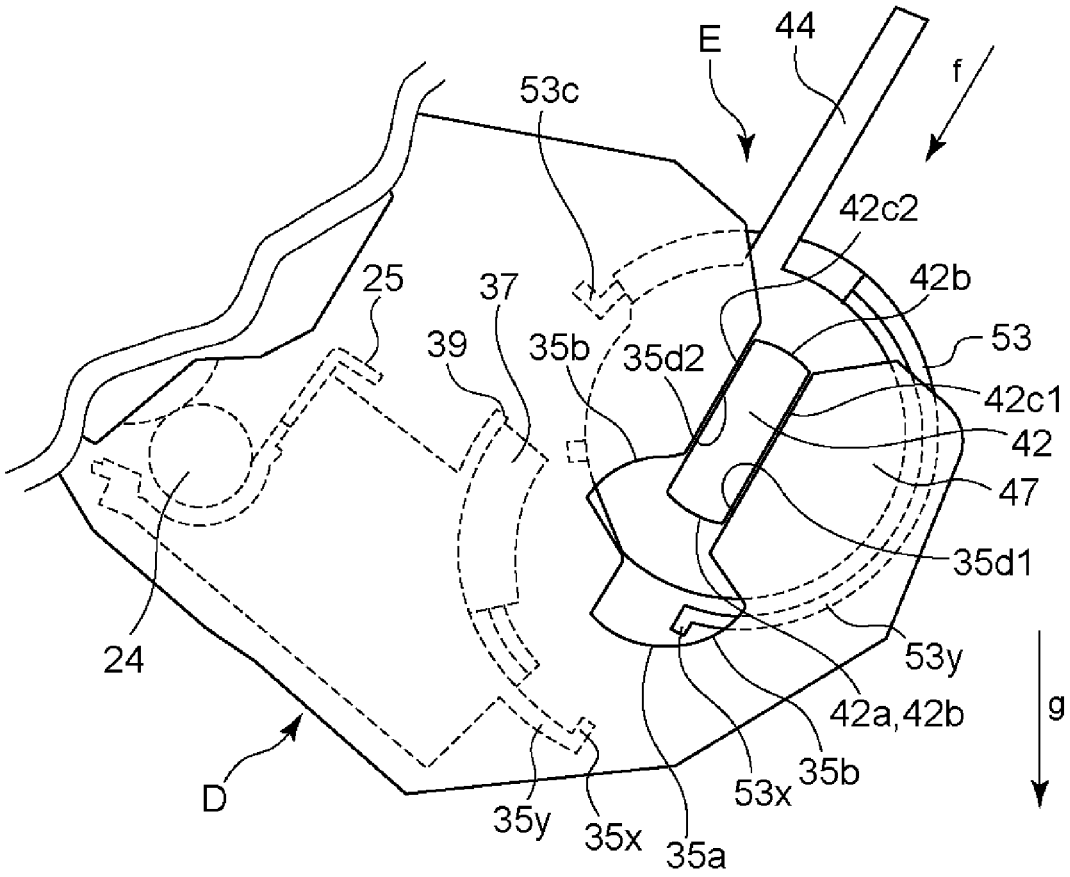
FIG. 7 is a schematic illustration of the developing unit and the toner cartridge during mounting (insertion).

Referring to FIG. 1, FIG. 6 and FIG. 7, the operation of inserting the toner cartridge E into the developing unit D will be described. Here, for the sake of convenience in explanation, in FIG. 1, part (b) of FIG. 6, and Figure, the insertion guided portions 35*d* and 36*d* are seen through.

Part (a) of FIG. 1 is a side view as viewed from the side opposite to the second drive transmission portion 48 along the longitudinal direction when the toner cartridge E is inserted into the developing unit D. Part (b) of FIG. 1 is a side view of the toner cartridge E and the developing unit D as viewed from the driving side, and shows a positional relationship of the operating portion 44 and the abutting portion 43*a* in the mounting direction of the toner cartridge E. FIG. 6 is a schematic illustration of the toner cartridge E and the developing unit D in a state before the toner cartridge E is mounted (inserted), wherein part (a) of FIG. 6 is a perspective view thereof, and part (b) of FIG. 6 is a side view thereof.

FIG. 7 is a side view of the toner cartridge E and the developing unit D in the state of mounting (inserting) the toner cartridge E.

As shown in part (a) of FIG. 1, and the toner cartridge E includes a rotation guided portion (to be guided for rotation) 42*b*. This rotation guided portion 42*b* is a rotation guide (toner cartridge side rotation guide) for guiding the container frame 47*a* when the toner cartridge E is rotated to open and close the first shutter 37 and the second shutter 53. The rotation guided portion 42*b* has a curved surface shape (substantially circular arc shape) extending around the rotation axis S of the toner cartridge E (details will be described later).

In this embodiment, on the non-driving side, the abutting portion 42*a*, the rotation guided portion 42*b*, the restricting portion 42*c*1, and the restricting portion 42*c*2 are formed integrally with a insertion guided portion (to be guided for insertion) 42*b*. However, they may be provided as separate members as long as they satisfy the respective functions.

As shown in part (b) of FIG. 1, the insertion guided portion 43 has an abutting portion 43*a* abutting to the abutted portion 36*a* of the developing unit D when inserting the toner cartridge E. The insertion guided portion 43 also serves as a rotation guided portion (toner cartridge side rotation guided portion) for guiding the container frame 47*a* when the abutting portion 43*a* opens and closes the first shutter 37 and the second shutter 53.

In this embodiment, on the driving side, the insertion guided portion 43*b* and the abutting portion 43*a* may be constituted by separate members. In addition, the rotated guide portion may be a member different from the abutting portion 43*a*. As described above, the portions (non-functional portions, non-contact portions) where the toner cartridge E and the developing unit D do not abut each other may be appropriately omitted, taking the strength and the like into consideration.

In addition, in this embodiment, the insertion guided portion 43 is provided at the end portion of the second drive transmission portion 48 of the end portion in the longitudinal direction of the second toner feeding portion 46. However, the insertion guided portion 43 may be provided on the container frame 47*a*.

Here, referring to part (a) of FIG. 1, the position of the operating portion 44 in the container frame 47*a* will be described. Part (a) of FIG. 1 is a side view of the side opposite to the second driving force transmitting portion 48 as the toner cartridge E is viewed in the longitudinal direction of the second toner feeding portion 46. In this Figure, the positional relationship between the operating portion 44 and the abutting portion 42*a* with respect to the inserting direction f is shown.

Here, the inserting direction f will be described. The direction along the surface of the restricting portion 42*c* is the f direction. More specifically, among the directions along the surface of the regulating portion 42*c*, the direction in which the abutting portion 42*a* is on the downstream side with respect to the insertion guided portion 42 can be said to be the f direction. That is, the direction in which the toner cartridge E is inserted into the developing unit D is the f direction.

The plane (an imaginary plane passing through the rotation center S of the container frame 47*a*) which is parallel to the inserting direction f of the restricting portion 42*c*1 and the toner cartridge E regulated by the restricting portion 42*c*1 and which passes through the abutting portion 42*a* and the abutting portion 43*a* is a plane m.

The operating portion 44 is placed on the downstream side of the plane m (direction e in part (a) of FIG. 1) in the opening direction of the third opening portion 49 (part (d) of FIG. 5). Here, the opening direction (direction of arrow e) of the third opening portion 49 is a direction (setting direction) in which the toner cartridge E is rotated to set the toner cartridge E to the developing unit D.

Next, the operation of inserting the toner cartridge into the developing unit will be described.

As shown in part (a) of FIG. 6, before the toner cartridge E is mounted on the developing unit D, the first shutter 37 is in the closing position for closing the second opening portion 30 (not shown), and the second shutter 53 is in the closing position for closing the third opening portion 49 (not shown). That is, the second opening portion 30 (part (b) of FIG. 4) of the developing unit D and the third opening portion 49 (part (e) of FIG. 5) of the toner cartridge E are closed by the first shutter 37 and the second shutter 53, respectively.

The insertion guided portion 42 of the toner cartridge E is provided with a restricted portion 42*c*1 and 42*c*2 (a restricted surface, an attitude restricting portion, an inserting direction restricting portion) for regulating the insertion attitude and dismounting attitude (inserting direction, removal direction) of the cartridge E in the mounting.

The user grips the operating portion 44 and moves the toner cartridge E relative to the developing unit D in the inserting direction f. The user moves the toner cartridge E such that the insertion guided portion 42 of the toner cartridge E and the insertion guide portion 35*d* of the developing unit D are engaged with each other, and the insertion guided portion 43 and the insertion guide portion 36*d* are engaged with each other. As the insertion guided portions 42, 43 are guided by the insertion guide portions 35*d*, 36*d* of the developing unit D, the attitude of the toner cartridge E when the toner cartridge E is mounted is stabilized.

Here, as shown in part (b) of FIG. 6, in this embodiment, the insertion guided portions 42, 43 and the insertion guide portions 35*d*, 36*d* are constituted so that the inserting direction f is inclined relative to the gravity direction g.

In other words, the toner cartridge E is inserted, while the restricted portion 42*c*1 on the lower side, in the direction of gravity g, of the insertion guided portion 42 and the surface 35*d*1 on the lower side, in the direction of gravity g, of the insertion guide portion 35*d* are in contact with each other (part (a) of FIG. 1). Similarly, the toner cartridge E is inserted, while the restricting portion 42*c*2 on the lower side, in the direction of gravity g, of the insertion guided portion 42 and the surface 35*d*2 on the lower side, in the direction of gravity g, of the insertion guide portion 35*d* are in contact with each other (part (b) of FIG. 1).

And, as shown in FIG. 7, the restricting portion 42*c*1 on the lower side, in the direction of gravity g, of the insertion guided portion 42 rides on the surface 35*d*1 of the insertion guide portion 35*d*, by which the positions of the insertion guided portion 42 relative to the insertion guide portion 35*d* and the rotation guide portion 35*b* is determined in the direction other than the f direction. By this, the attitude of the toner cartridge E with respect to the developing unit D is determined.

As shown in part (a) of FIG. 1, the insertion guided portion 42 provided in the toner cartridge E is provided with an abutting portion 42*a*. As the user moves the toner cartridge E further in the f direction while maintaining its attitude, the abutting portion 42*a* abuts to the abutted portion 35*a* provided in the developing unit D. Similarly, as shown in part (b) of FIG. 1, the abutting portion 43*a* provided on the toner cartridge E abuts against the abutted portion 36*a* provided in the developing unit D. By this, the insertion of the toner cartridge E is completed.

(Positioning of Toner Cartridge Relative to Developing Unit)

Referring to part (a) of FIG. 10, part (b) of FIG. 10, part (a) of FIG. 11, part (b) of FIG. 11, the positioning of the toner cartridge E relative to the developing unit D will be described.

Figure 10:
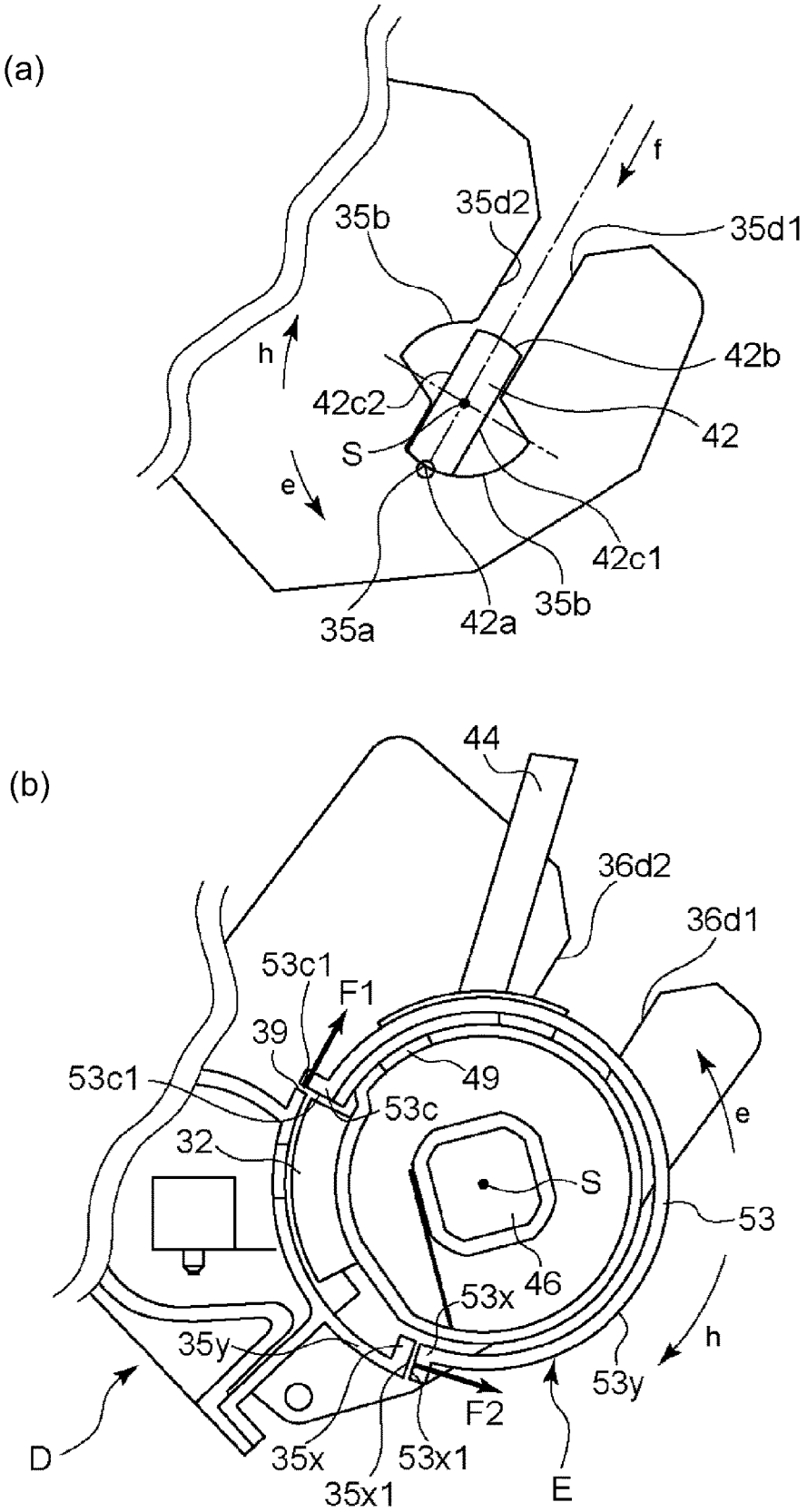
FIG. 10 is a schematic illustration showing a state in which an abutting portion abuts to an abutted portion.

Part (a) of FIG. 10 is a side view of the insertion guided portion 42 of the toner cartridge E and the frame 35 of the developing unit D in a state that the abutting portion 42*a* and the abutted portion 35*a* are abutted to each other. Part (b) of FIG. 10 is a sectional view of the toner cartridge E and the developing unit D in a state in which the abutting portion 42*a* and the abutted portion 35*a* abut to each other.

Figure 11:
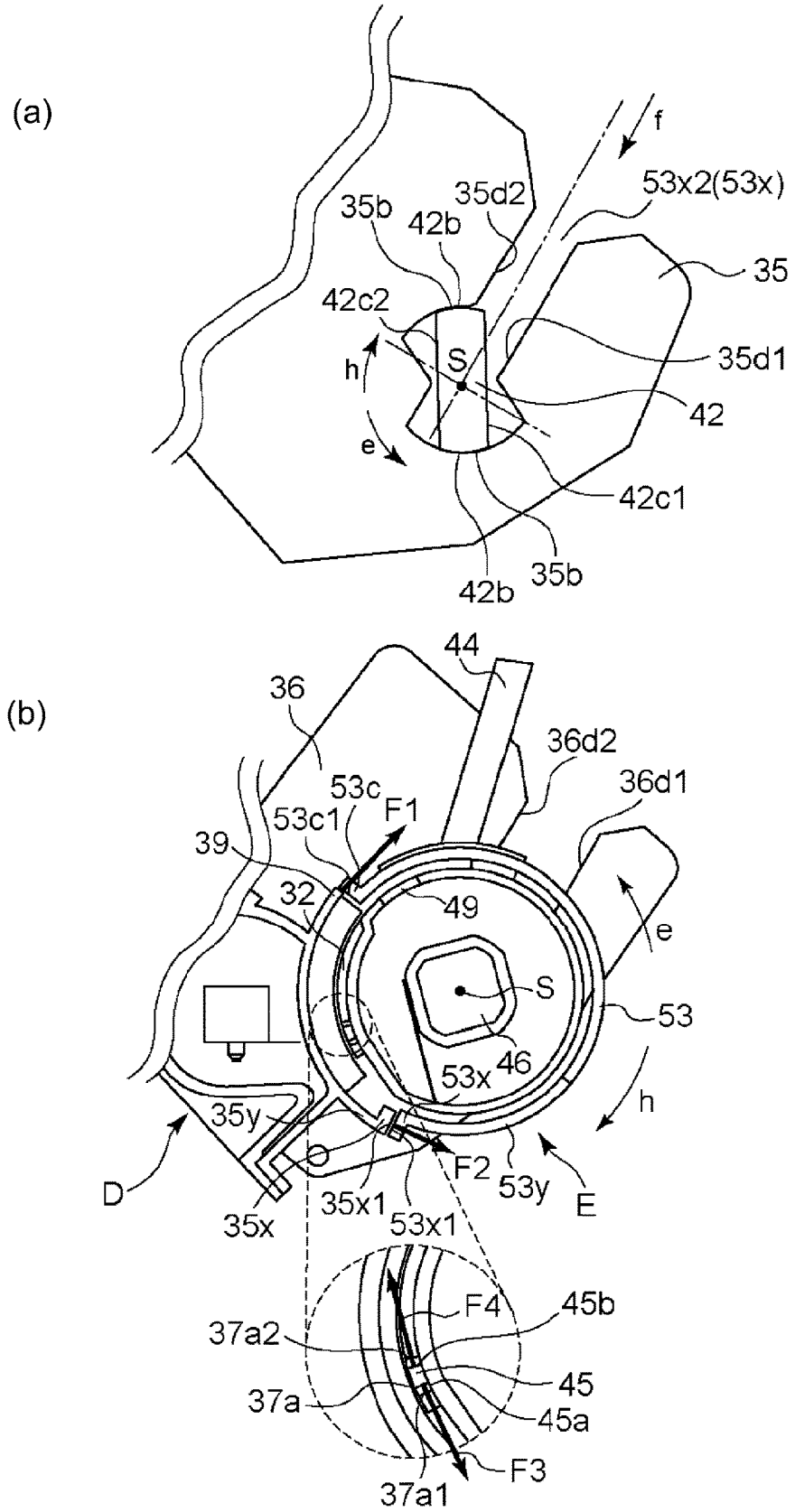
FIG. 11 is a schematic illustration when a container frame is rotated and the toner cartridge is positioned.

Part (a) of FIG. 11 is a side view of the insertion guided portion 42 of the toner cartridge E and the frame 35 of the developing unit D in a state that the toner cartridge E is positioned relative to the developing unit D. Part (b) of FIG. 11 is a sectional view illustrating the engaging relationship between the toner cartridge E and the developing unit D which are positioned. More specifically, part (b) of FIG. 11 is a cross-sectional view of the toner cartridge E and the developing unit D, taken along a plane passing through the position of the second shutter 53.

Part (a) of FIG. 10 shows a state after completion of insertion of the toner cartridge E into the developing unit D. In order to open and close the first shutter 37 and the second shutter 53, the container 47 is rotated in the direction of the arrow e around the rotation axis S of the toner cartridge E. Then, as shown in part (a) of FIG. 11, the abutting portion 42*a* and the rotation guided portion 42*b* are engaged with the rotation guide portion 35*b*. By this, the toner cartridge E is positioned relative to the developing unit D. At this time, the rotation guided portion 42*b* is guided by the rotation guide portion 35*b* provided in the developing unit D. By this, the container 47 can rotate smoothly.

[Opening and Closing Operation of Shutter]

In the following, the opening and closing operations of the first shutter 37 provided in the developing unit D and the second shutter 53 provided in the toner cartridge E will be described in detail.

In this embodiment, in the course of mounting the toner cartridge E to the developing unit D, the first shutter 37 of the developing unit D and the second shutter 53 of the toner cartridge E open the second opening portion 30 and the third opening portion 49 (move to the open positions), respectively. On the contrary, in the process in which the toner cartridge E is removed from the developing unit D, the first shutter 37 and the second shutter 53 close the second opening portion 30 and the third opening portion 49, respectively (move to the closed positions).

The toner cartridge E is mounted to the developing unit D at least by a mounting operation including a rotating operation. More specifically, after the toner cartridge E is linearly inserted into the developing unit D, it is mounted with rotation relative to the developing unit D. In interrelation with the rotating operation in the mounting of the toner cartridge E, the first shutter 37 and the second shutter 53 move from the closed position to the open position, respectively.

Similarly, the toner cartridge E is dismounted from the developing unit D by a dismounting operation including at least a rotating operation. More specifically, after rotating relative to the developing unit D, the toner cartridge E is dismounted from the developing unit D substantially linearly.

The first shutter 37 and the second shutter 53 move to the open position as the toner cartridge E is rotated at the time of removal.

(Opening Operation of Shutter)

Figure 12:
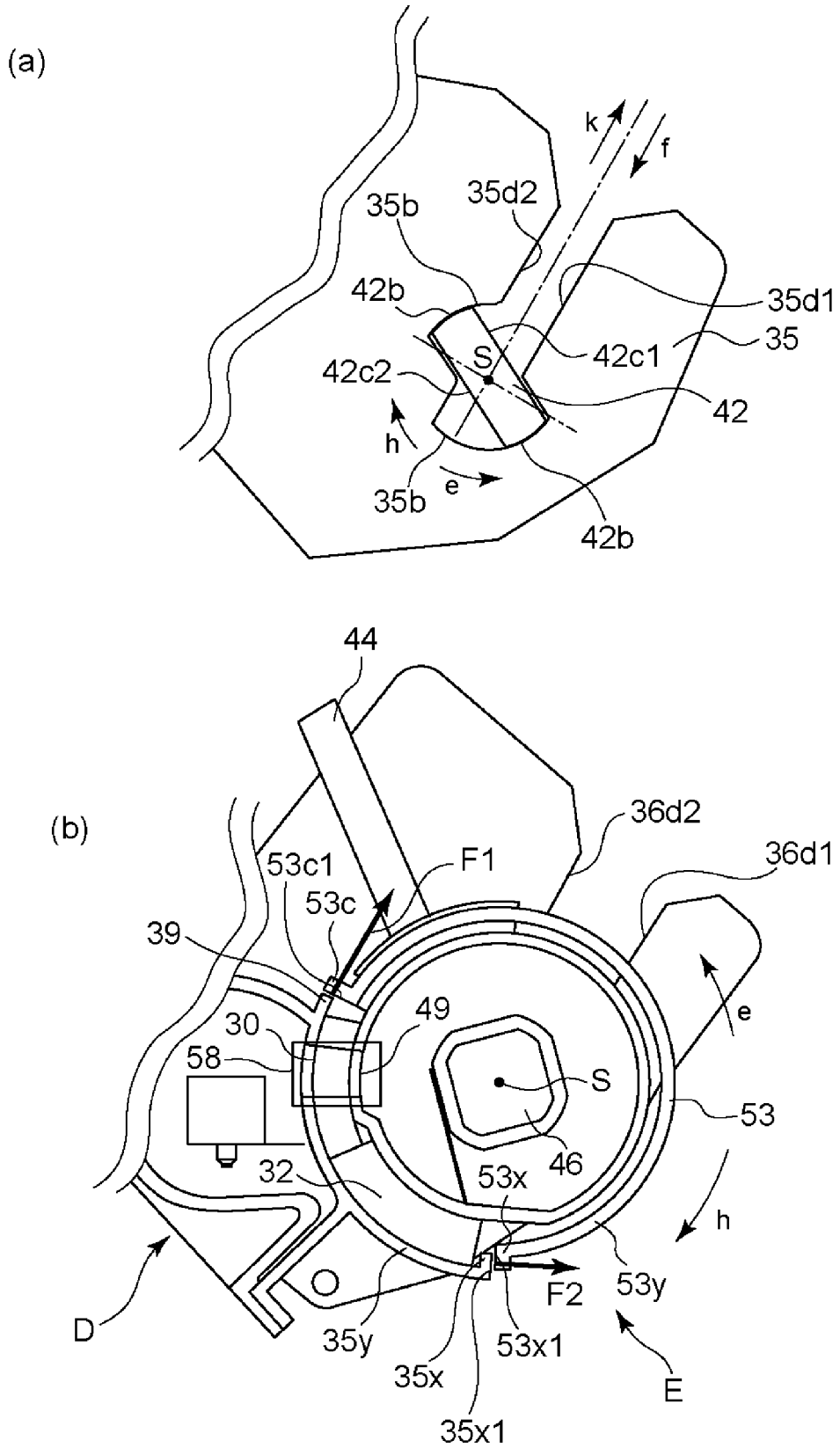
FIG. 12 is a schematic illustration when each shutter moves to the open position and each toner storing portion is communicated.

Refer to part (a) of FIG. 1, part (b) of FIG. 10, part (a) of FIG. 11, part (b) of FIG. 11, part (a) of FIG. 12 and part (b) of FIG. 12, the opening operation of the first shutter 37 of the developing unit D and the second shutter 53 of the toner cartridge E will be described. Part (a) of FIG. 12 is a side view of the insertion guided portion 42 of the toner cartridge E and the frame 35 of the developing unit D in the state in which the second opening portion 30 and the third opening portion 49 are opened. Part (b) of FIG. 12 is a sectional view of the toner cartridge E and the developing unit D in the state in which the second opening portion 30 and the third opening portion 49 are opened.

In this embodiment, the relative positions of the second opening portion 30 and the third opening portion 49 can be different from each other in a state where the toner cartridge E is positioned relative to the developing unit D (mounted state). In other words, the structure is such that by rotating the toner cartridge E, it is possible to take at least two positions (two states) in the state that the toner cartridge E is mounted to the developing unit D.

The first position of the toner cartridge E is a non-communicating position (part (b) of FIG. 10) in which the second opening portion 30 and the third opening portion 49 do not overlap so that the first toner containing portion 28 and the second toner containing portion 47*t* are not in communication with each other. In this state, the first shutter 37 is in the closed position closing the second opening portion 30.

The second position of the toner cartridge E is a communication position (part (b) of FIG. 12) in which the second opening portion 30 and the third opening portion 49 overlap so that the first toner containing portion 28 and the second toner containing portion 47*t* are in communication with each other. In this state, the first shutter 37 is in the open position where the second opening portion 30 is opened.

As shown in part (a) of FIG. 1, when the toner cartridge E is inserted into a predetermined position of the developing unit D, the projection 45 of the container frame 47*a* and the hole portion 37*a* of the first shutter 37 are engaged with each other.

That is, the insertion guided portion 42 is guided by the insertion guide portion 35*d*, by which the insertion attitude of the toner cartridge E is restricted so that the projection 45 can be inserted into the hole portion 37*a*.

In addition, when the toner cartridge E is inserted into a predetermined position of the developing unit D, the first abutting portion 53*c* of the second shutter 53 and the collision surface (opening force applying portion) 39 of the developing unit D face each other. That is, the insertion guided portion 42 is guided by the insertion guide portion 35*d*, by which the insertion attitude of the toner cartridge E is restricted so that the first abutting portion 53*c* faces the collision surface 39.

In addition, the second abutting portion 53*x* of the second shutter 53 and the toner receiving portion 35*x* of the developing unit D face each other. That is, the insertion guided portion 42 is guided by the insertion guide portion 35*d*, by which the insertion attitude of the toner cartridge E is restricted so that the second abutting portion 53*x* of the second shutter 53 and the toner receiving portion 35*x* of the developing unit D face each other.

By the operation of the operating unit 44 of the toner cartridge E by the user, the container frame 47*a* is rotated in the direction of arrow e from the mounting position shown in part (a) of FIG. 1. By this, the state of engagement between the insertion guided portion 42 and the frame 35 is changed from the state shown in part (a) of FIG. 11 to the state in which the second opening portion 30 and the third opening portion 49 shown in part (a) of FIG. 12 overlap each other (not shown). At this time, the rotation axis S of the toner cartridge E (container frame 47*a*) is substantially parallel to the longitudinal direction of the toner cartridge E.

When container frame 47*a* starts to rotate in the direction of arrow e, as shown in part (b) of FIG. 10, the surface 53*c*1 on the downstream side, in the direction of the arrow e, of the first abutting portion 53*c* abuts against the collision surface 39 provided on the developing unit D. By this, the surface 53*c*1 receives the force F1 from the collision surface 39 of the developing unit D. And, as shown in part (b) of FIG. 11, during rotation of the container frame 47*a* in the direction of arrow e, the surface 53*c*1 continues to receive the force F1 from the collision surface 39. Therefore, the second shutter 53 does not rotate in the direction of arrow e simultaneously together with the container frame 47*a*.

That is, the collision surface 39 restricts the rotation of the second shutter 53 simultaneously together with the container frame 47*a* in the direction of the arrow e. The force F1 received by the first abutting portion 53*c* is a force for moving the second shutter 53 from the closed position to the open position.

From this state, the container frame 47*a* is further rotated in a direction (direction of arrow e) in which the toner cartridge E is mounted to the developing unit D. Then, the container frame 47*a* moves in a direction (opening direction) in which the third opening portion 49 for supplying the toner to the developing unit is opened.

In other words, the second shutter moves relative to the container frame 47*a* in the direction of opening the third opening portion 49.

In addition, as shown in part (b) of FIG. 11, when the container frame 47*a* rotates in the direction of the arrow e, the surface 45*a* of the projection 45 and the surface 37*a*1 of the hole portion 37*a* come into contact with each other, so that a force F3 is applied from the surface 45*a* to the surface 37*a*1. By this, the first shutter 37 is pushed in the rotational direction (the direction of the arrow e) of the container frame 47*a*. As a result, the first shutter 37 moves in interrelation with the rotation of the container frame 47*a*, so that the second opening portion 30 is opened. The projection (projection, projection) 45 provided on the container frame 47*a* is a release force applying portion (open position moving portion, opening/closing member moving portion) for applying a force to the first shutter 37 to move the first shutter 37 to the open position.

Thereafter, as shown in part (a) of FIG. 12 and part (b) of FIG. 12, the first toner containing portion 28 and the second toner containing portion 47 are in a state of communication through the third opening portion 49 and the second opening portion 30. By this, the opening operation of the second opening portion 30 and the third opening portion 49 is completed.

At this time, the abutting portion 42*a* and the rotation guided portion 42*b* are engaged with the rotation guide portion 35*b*. By this, the relative movement of the toner cartridge E in the direction of the arrow e relative to the developing unit D is restricted in a state that the second opening portion 30 and the third opening portion 49 are opened.

In this state, the second drive transmission portion 48 of the toner cartridge E is connected (not shown) to the drive transmission portion 38 (part (a) of FIG. 4) of the development unit D. By this, the driving force for rotating the second toner feeding member 46 is in a state of ready for transmission from the developing unit D.

From the foregoing, transportation (supply) of the toner t from the second toner containing portion 47*t* of the toner cartridge E to the first toner containing portion 28 of the developing unit D is enabled. Here, in this embodiment, the drive transmission portion 38 for transmitting the drive to the second drive transmission portion 48 of the toner cartridge E is provided on the developing unit D side.

However, as shown in FIG. 14, a drive transmission portion 38 which meshes with the second drive transmission portion 48 may be provided on the toner cartridge E side. Here, FIG. 14 is a side view of the toner cartridge E as viewed from the drive side in the case where a drive transmission portion 38 meshing with the second drive transmission portion 48 is provided. In part (a) of FIG. 14, the third opening portion 49 (not shown) is closed by the second shutter 52. In addition, part (b) of FIG. 14 shows a state in which the third opening portion 49 (not shown) is opened.

In the modification shown in FIG. 14, two gears are provided on the toner cartridge E. The drive transmission gear 38 is a drive input gear for receiving a driving force from the developing unit D. And, the second drive transmission portion 48 transmits the driving force received by the drive input gear (drive transmission portion 38) as the second gear (transmission gear) to the second toner feeding member 46 (part (b) of FIG. 12). The second drive transmission portion 48 and the second toner feed member 46 are coaxially arranged.

Here, the engagement between the gears is called a meshing, and even when a belt or the like provided with the projection engages, it is considered as meshing.

(Switching from Toner Cartridge Inserting Operation to Shutter Opening Operation)

Figure 9:
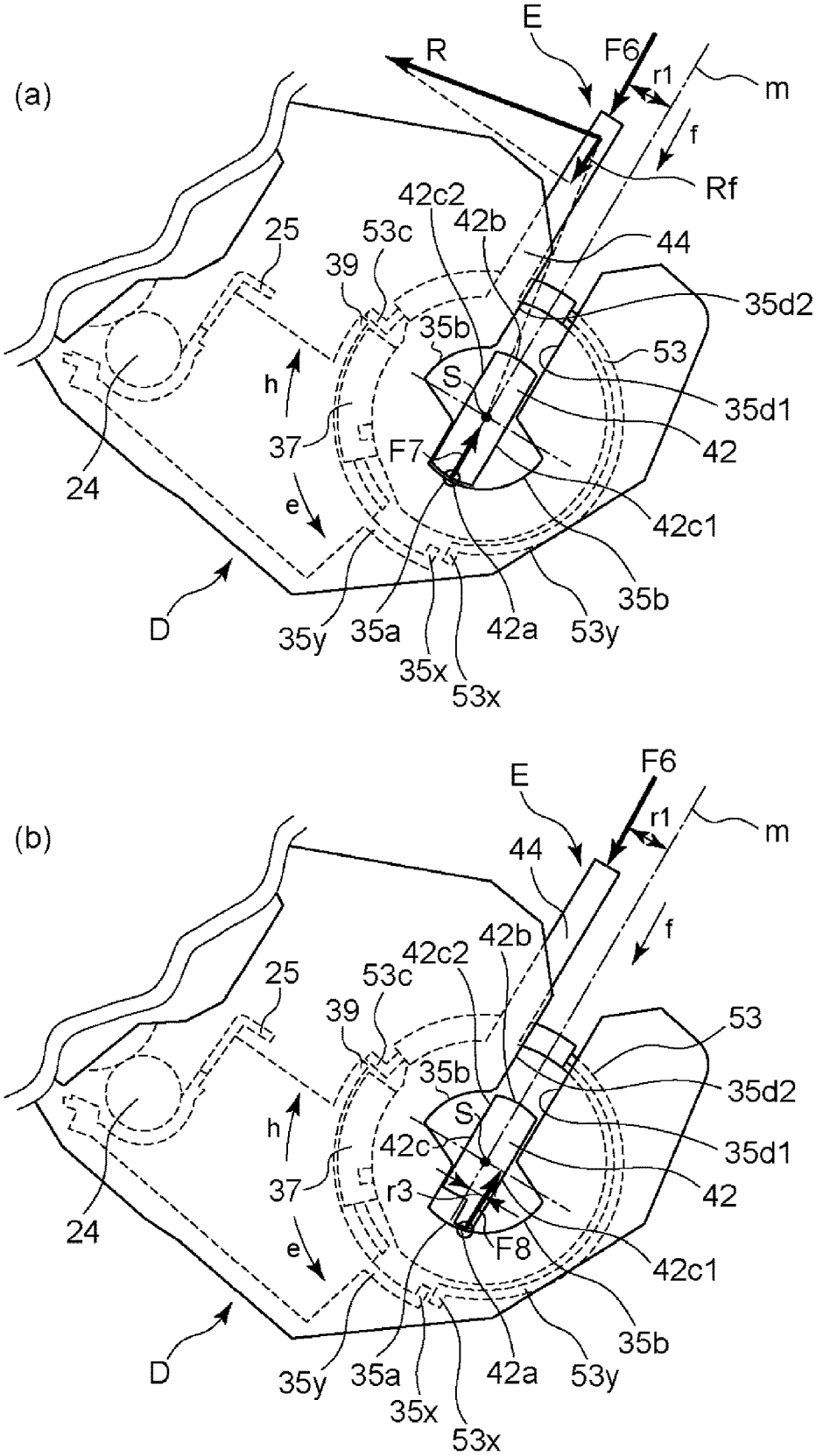
FIG. 9 is a schematic side view illustrating a force relationship acting on the toner cartridge.

Next, referring to parts (a) of FIGS. 1, 9, and part (b) of FIG. 9, the switching operation from the inserting operation of the toner cartridge E to the shutter opening operation which is a feature of this embodiment will be described. Part (a) of FIG. 9 is a side view illustrating the force relationship on the toner cartridge E when the insertion into the developing unit D is completed. In addition, part (b) of FIG. 9 is a side view illustrating a force relationship on the toner cartridge E in another structure example of the abutting portion 42*a*.

Here, for the sake of convenience of explanation, the insertion guided portion 35*d* is seen through.

As shown in part (a) of FIG. 9, the toner cartridge E is inserted into the developing unit D by a user operation, and the abutting portion 42*a* and the abutted portion 35*a* abut each other. At this time, a force F6 and a force F7 act on the toner cartridge E. More specifically, the force F6 applied when the toner cartridge E is inserted by the user acts on the operating portion 44, and the equivalent reaction force F7 acts to the abutting portion 42*a* of the insertion guided portion 42.

Here, a plane (imaginary plane) m that is parallel to the mounting direction of the toner cartridge E passing through the rotation axis S of the toner cartridge E (rotation center of the second shutter member 53) is taken. The length of the arm from the imaginary surface m to the operating portion 44 is r1, and the length of the arm from the rotational axis (rotation center) S to the abutting portion 42*a* is r2. At this time, the moment M acting on the rotational axis S of the third opening portion 49 (part (d) of FIG. 5) of the toner cartridge E can be expressed by the following equation.

$$M=F6\times r1+F7\times r2$$

In addition, as shown in part (a) of FIG. 9, when the second opening portion 30 and the third opening portion 49 are opened, the rotational direction of the toner cartridge E (the container frame 47*a*) is the counterclockwise arrow e direction as the toner cartridge E is viewed along the axial direction of rotation of the container frame 47*a*. Here, in this embodiment, the abutting portion 42*a* is positioned on a plane (imaginary plane) m passing through the rotation center S of the container frame 47*a* and parallel to the inserting direction (guide direction) f, and therefore, r2=0. Also, the operating portion 44 is provided on the downstream side of the plane m in the rotational direction e when the opening direction (the direction of the arrow e) of the second opening portion 30 and the third opening portion 49 is forward.

Therefore, F6×r1>0, and therefore, M>0.

Since F6×r1>0 and M>0, a force F6 applied by the user when the toner cartridge E is inserted into the developing unit D is converted into a force to rotate the second opening portion 30 and the third opening portion 49 in the opening direction e. Therefore, the whole toner cartridge E is rotated by the force F6 in the direction of inserting the toner cartridge E in the direction f.

Here, the larger the value of the moment M is, the more easily the toner cartridge E is rotated. In other words, the larger the value of the moment M, the easier and smoother it is to operate the opening operation of the second opening portion 30 and the third opening portion 49.

Here, as a structure for increasing the moment M, as shown in part (b) of FIG. 9, it is conceivable to change the position where the abutting portion 42*a* is provided, for example. More specifically, it is conceivable that the abutting portion 42*a* is placed at a position passing through the rotation center S of the container frame 47*a* and apart from the imaginary surface m parallel to the mounting direction f on the side opposite to the operating portion 44.

Assuming that the force acting on the abutting portion 42*a* is F8 and the distance from the imaginary plane m to the abutting portion 42*a* is r3, the moment M acting on the rotation center S can be expressed by the following equation as with the structure in part (a) of FIG. 9.

$$M=F6\times r1+F8\times r3$$

At this time, F8×r3 is a moment in the opening direction e of the second opening portion 30 and the third opening portion 49. Therefore, the moment M becomes large, and therefore the container frame 47*a* is easy to rotate in the opening direction e. Here, the above-described positional relationship between the abutting portion 42*a* and the operating portion 44 can be applied to the relationship between the abutting portion 43*a* and the operating portion 44 to provide the same effects.

(Closing Operation of Shutter)

Referring to part (a) of FIG. 10, part (b) of FIG. 10, part (b) of FIG. 11, part (b) of FIG. 12, the closing operation of the first shutter 37 of the developing unit D and the second shutter 53 of the toner cartridge E will be described. The closing operation of the first shutter 37 and the second shutter 53 is performed in the opposite operation to the opening operation described above. Here, the closing direction of the first shutter 37 and the second shutter 53 is the direction in which the container frame 47*a* rotates in the clockwise direction (the direction of the arrow h in part (b) of FIG. 12) as viewed in the axial direction from the side opposite to the side of the second drive transmission portion 48 provided.

First, in the state of part (b) of FIG. 12, the user operates the operating portion 44 to rotate the container frame 47*a* in the closing direction (the direction of arrow h, the closing direction). Then, as shown in part (b) of FIG. 11, the surface 45*b* of the projection 45 of the container frame 47*a* abuts to the surface 37*a*2 of the hole portion 37*a* of the first shutter 37 so that a force F4 is applied from the surface 45*b* to the surface 37*a*2. By this, the surface 37*a*2 of the first shutter 37 receives a force in the direction of the arrow h from the surface 45*b* to rotate in interrelation with the rotating operation of the container 47. And, the first shutter 37 moves to the closed position where the first shutter 37 closes the second opening portion 30. The surface 45*b* of the projection 45 is a closing force applying portion which moves the first shutter 37 to the closed position by applying a force to the first shutter 37.

In addition, in the state of FIG. 12, the user operates the operating portion 44 to rotate the container frame 47*a* in the closing direction (the direction of arrow h, the closing direction). When container frame 47*a* starts to rotate in the direction of arrow h, as shown in part (b) of FIG. 12, the surface 53*x*1 of the second abutting portion 53*x* provided on the second shutter 53 on the downstream side in the direction of the arrow h abuts to the surface 35*x*1 on the upstream side, in the direction of arrow h, of the toner receiving portion 35*x*. By this, the surface 53*x*1 receives the force F2 from the surface 35*x*1. For this reason, even when the container frame 47*a* rotates in the direction of the arrow h, the surface 53*x*1 continues to receive the force F2 from the surface 35*x*1. Therefore, the extending portion 53*y* provided with the second abutting portion 53*x* does not rotate together with the container frame 47*a* in the direction of the arrow h.

That is, the toner receiving portion 35*y* regulates rotation of the second abutting portion 53*x* together with the container frame 47*a* in the direction of arrow h. The force F2 received by the second abutting portion 53*x* is a force for moving the second shutter 53 from the open position to the closing position.

And, when the container frame 47*a* is further rotated in the closing direction (direction of arrow h), as shown in part (a) of FIG. 10 and part (b) of FIG. 10, the toner cartridge E can be removed from the developing unit D. At this time, the second opening portion 30 and the third opening portion 49 are closed by the first shutter 37 and the second shutter 53, respectively.

In the state that the toner cartridge E has been inserted in the mounting position of the developing unit D, the operating portion 44 is positioned on the downstream side, in the rotational direction, of the container frame 47*a*, relative to an imaginary line passing through the center of rotation and extending in the inserting direction f, as seen in the direction of the axis of rotation of the container frame 47*a*. The structure is such that in this position, the operating unit 44 receives a force to rotate the container frame 47*a* by the user's operation. This position is a position where a moment acting to rotate the container frame 47*a* relative to the developing unit D occurs when the operating portion 44 receives a force acting in the inserting direction f.

In other words, in the case of the structure of the toner cartridge E according to this embodiment, the force (arrow R in FIG. 9) acting on the operating portion 44 when rotating the container frame 47*a* at this position is a component force in the inserting direction f (FIG. 9, arrow Rf). As the user applies force in the inserting direction f to the operating portion 44 at the time of insertion, a force in the inserting direction f acts on the operating portion 44 at the time when the toner cartridge E reaches the mounting position. That is, at the time when the toner cartridge E reaches the mounting position, a portion of the force required to rotate the container frame 47*a* has already been applied to the operating unit 44. Therefore, by the operation of the user pushing the operating unit 44 in the inserting direction f, the force in the inserting direction f continues to be applied to the operating portion 44 also when the container frame 47*a* rotates following insertion of the toner cartridge E into the mounting position.

By this, in the series of mounting operation in which the user grips the operating portion (grip portion) 44, inserts the toner cartridge E to the mounting position of the developing unit D and then rotates the container frame 47*a*, the force is smoothly converted from the inserting operation to the rotating operation. Therefore, the user can intuitively operate the insertion of the toner cartridge E into the developing unit D and the opening operation of the first shutter 37 and the second shutter 53, thereby significantly improving operability.

In addition, in this embodiment. The structure is such that as viewed in the direction of the rotation axis of the container frame 47*a*, the operating portion (gripping portion) 44 receives a force at a position more remote from the rotation center than the abutting portion 42*a*, when the toner cartridge E is at the mounting position. By this, the container frame 47*a* can be rotated with a small force against the sliding resistance between the abutting portion 42*a* and the abutted portion 35*a* and the rotation guide portion 35*b* when the container frame 47*a* rotates, by the principle of leverage. The same applies to the sliding resistance between the abutting portion 43*a* and the abutted portion 36*a* and the rotating guide 36*b*.

(Modifications of Extending Portion and Abutting Portion)

Figure 8:
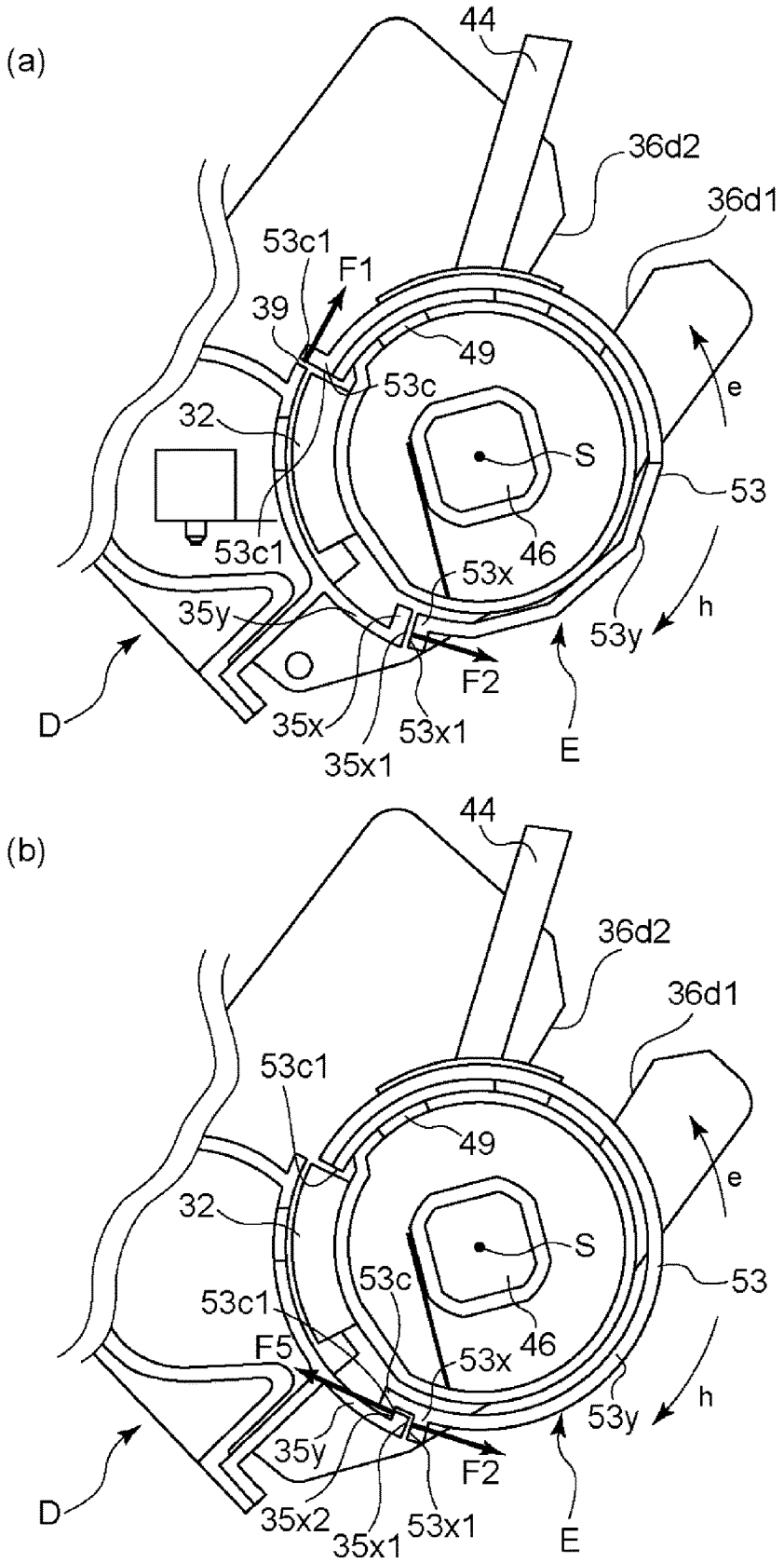
FIG. 8 is a side sectional view illustrating a modified example of the structure of the extending portion and the abutting portion of the toner cartridge.

Referring to FIG. 8, modified examples of the extending portion and the abutting portion provided on the second shutter 53 will be described. Part (a) of FIG. 8 is a side sectional view illustrating a modified example of the extending portion 53*y*, when the toner cartridge E is inserted into a predetermined position of the developing unit D. Part (b) of FIG. 8 is a side sectional view illustrating a modified example of the first abutting portion 53 *c*, when the toner cartridge E is inserted into a predetermined position of the developing unit D.

As shown in FIG. 1, in this embodiment, as seen along the longitudinal direction, the cross-sectional shape of the extending portion 53*y* is an arcuate shape on the extended line of the second shutter 53. However, the shape of the extending portion 53*y* is not limited to the arcuate shape. As shown in part (a) of FIG. 8, as seen along the longitudinal direction, the cross-sectional shape of the extending portion 53*y* may be a polygonal. Even in this case, when the toner cartridge E is inserted into a predetermined position of the developing unit D, the surface 53*x*1 of the second abutting portion 53*x* on the downstream side in the direction of arrow h faces the surface 35*x*1 on the upstream side, in the direction of arrow h, of the toner receiving portion 35*x*1.

As described in the foregoing, as seen along the longitudinal direction, the extending portion 53*y* is not limited to be provided in an arc shape on the extended line of the second shutter 53.

In this example, the first abutting portion (opening force receiving portion) 53*c* is provided at the leading end of the second shutter 53, and the second abutting portion (closing force receiving portion) 53*x* is provided at the extending portion 53*y* of the second shutter 53. However, as shown in FIG. 8, /both the first abutting portion (opening force receiving portion) 53*c* and the second abutting portion (closing force receiving portion) 53*x* may be provided on the extending portion 53*y*.

Here, FIG. 8 is a side sectional view of the toner cartridge E as seen from the opposite side in the longitudinal direction with respect to the driving side, when the toner cartridge E is inserted into a predetermined position of the developing unit D.

In FIG. 8, the first abutting portion (opening force receiving portion) 53*c* and the second abutting portion (closing force receiving portion) 53*x* are disposed adjacent to each other, at the end of the extending portion 53*y* (that is, the trailing end of the second shutter 53).

At this time, the insertion attitude of the toner cartridge E is restricted so that the surface 53*x*1, on the downstream side, in the direction of arrow h, of the second abutting portion 53*x* provided on the extending portion 53*y* faces the surface 35*x*1 on the upstream side, in the direction of arrow h, of the toner receiving portion 35*x*. The user operates the operating portion 44 to rotate the container frame 47*a* in the closing direction (direction of arrow h). At this time, as with the previously described structure, the surface 53*x*1 abuts to the surface 35*x*1. By this, the surface 53*x*1 receives the force F2 from the surface 35*x*1. For this reason, even when the container frame 47*a* rotates in the direction of the arrow h, the surface 53*x*1 continues to receive the force F2 from the surface 35*x*1. Therefore, the second shutter 53 provided with the second abutting portion 53*x* does not rotate together with the container frame 47*a* in the direction of the arrow h. Thus, the second shutter 53 moves relative to the container frame 47*a* to the closed position where the third opening portion 49 is closed.

In addition, the insertion attitude of the toner cartridge E is restricted such that the surface 53*c*1 on the upstream side, in the direction of arrow h, of the first abutting portion 53*c* provided on the extending portion 53*y* faces the surface 35*x*2 on the downstream side, in the direction of arrow h, of the toner receiving portion 35*x*. The user operates the operating unit 44 to rotate the container frame 47*a* in the opening direction (direction of the arrow e). At this time, the surface 53*c*1 abuts to the surface 35*x*2. By this, the surface 53*c*1 receives the force F5 from the surface 35*x*2. For this reason, even when the rotation of the container frame 47*a* in the direction of arrow h proceeds, the surface 53*c*1 continues to receive the force F5 from the surface 35*x*2. Therefore, the second shutter 53 provided with the first abutting portion 53*c* does not rotate together with the container frame 47*a* in the direction of arrow h.

Therefore, the second shutter 53 moves relative to the container frame 47*a* to a closed position where it closes the third opening portion 49.

As described above, the first abutting portion 53*c* may be provided on the extending portion 53*y*.

(Modified Example of Developing Unit D)

Figure 15:
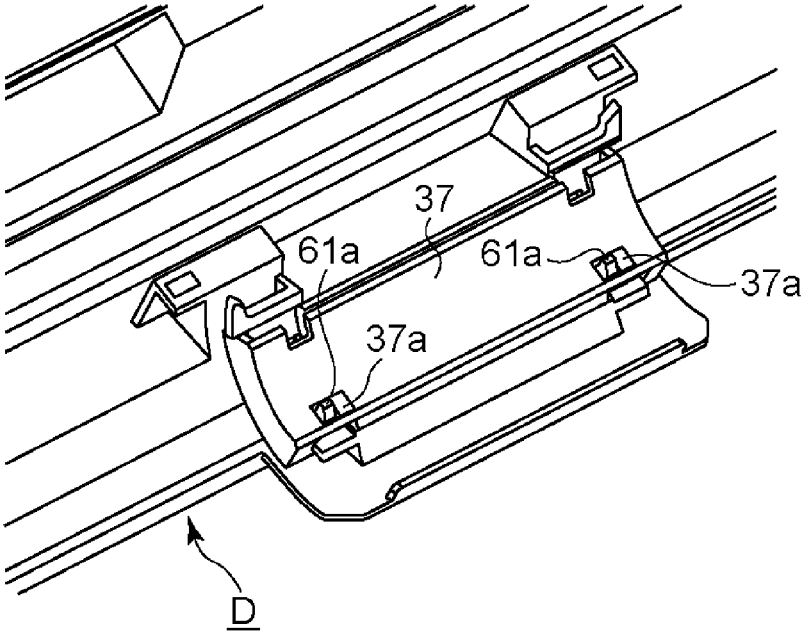
FIG. 15 is a view illustrating a modified example of the developing unit.
Figure 15:
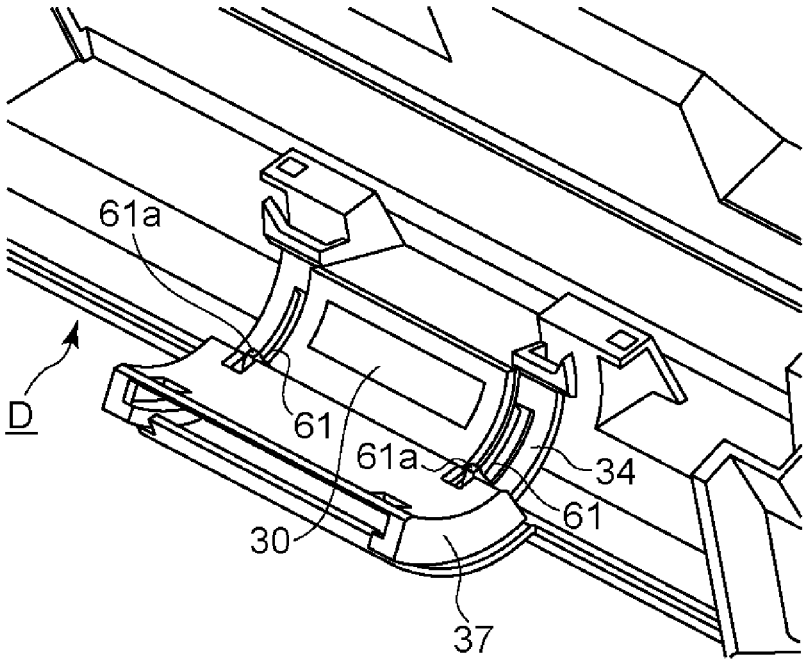
Figure 16:
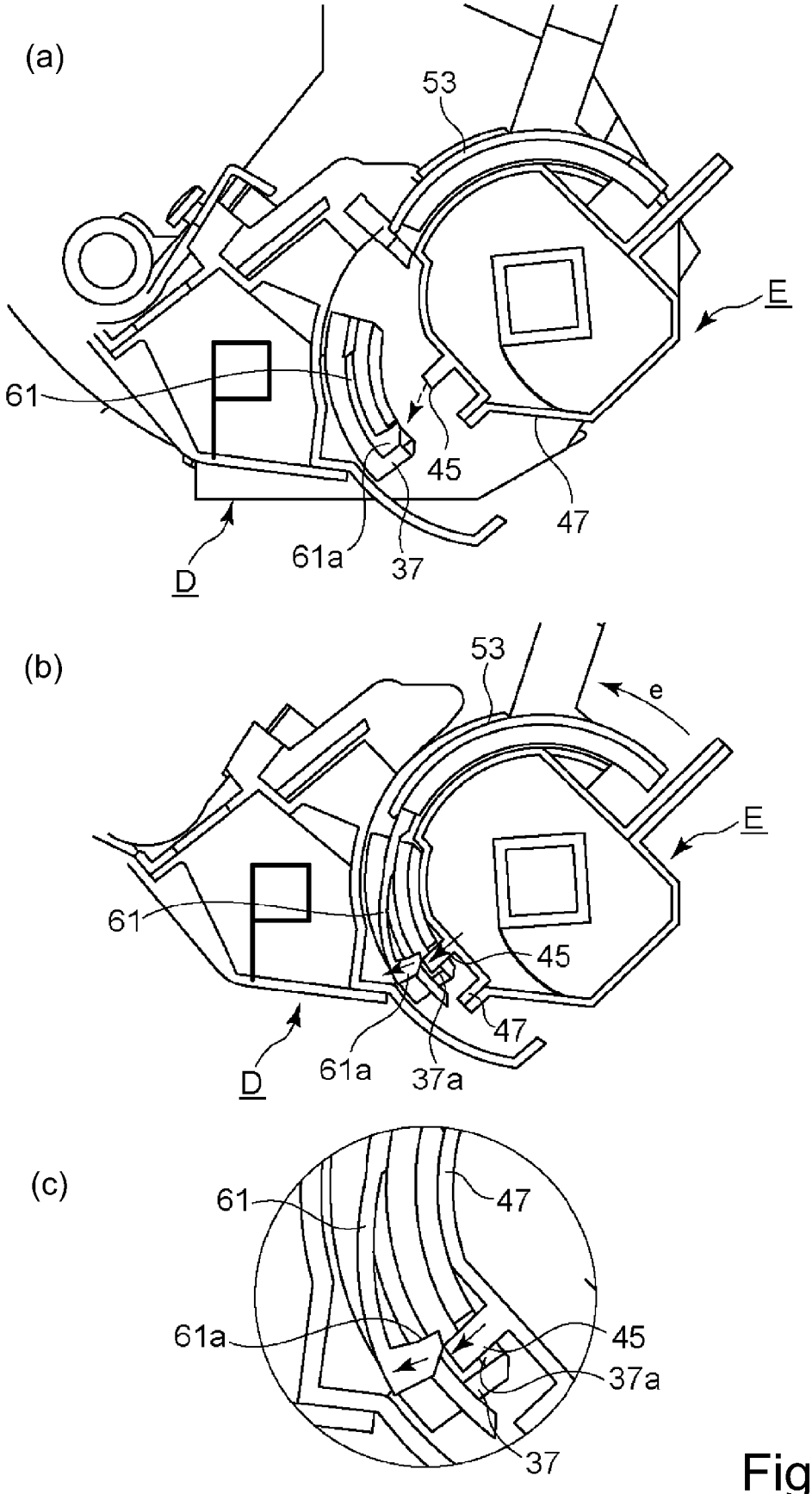
FIG. 16 is a view illustrating a modified example of the developing unit.

Next, referring to FIG. 15 and FIG. 16, a modified example of the developing unit D will be described. FIG. 15 is a perspective view illustrating a periphery of the first shutter 37 of the developing unit D, wherein part (a) shows a state where the first shutter 37 is opened, and part (b) shows a closed state. FIG. 16 is a sectional view of the toner cartridge E and the developing unit D. Part (a) of FIG. 16 shows a process of inserting the toner cartridge E into the developing unit D, and part (b) shows a state where the insertion of the toner cartridge E is completed. In addition, part (c) of FIG. 16 is an enlarged view of portion of part (b) of FIG. 16.

In this modified example, a lock arm (receiving apparatus side lock member) 61 is provided in the developing unit D, in order to prevent the first shutter 37 from unintentionally opening. As shown in FIG. 15, two lock arms 61 are provided on the developing unit D, and each of the lock arms 61 has a claw portion (engaging portion, projecting portion, locking portion) 61*a* at the leading end thereof. In addition, the lock arm 61 can be elastically deformed.

The claw portion 61*a* of the lock arm 61 is located at the same position as the hole portion 37*a* of the first shutter 37 in the longitudinal direction of the developing unit D.

And, in a state in which the first shutter 37 closes the second opening portion 30, the claw portion 61*a* enters the hole portion 37*a* and engages with the hole portion 37*a*. By this, the claw portion 61*a* locks the movement of the first shutter 37 and suppresses unintended opening of the first shutter 37.

Here, in the course of inserting the toner cartridge E into the developing unit D, the two projections 45 provided on the toner cartridge E come into contact with the corresponding claw portions 61*a* as shown in part (b) of FIG. 16. When the projection 45 comes into contact to the claw portion 61*a*, the lock arm 61 is elastically deformed, by which the claw portion 61*a* is retracted from the hole portion 37*a*, and the lock of the first shutter 37 is released. That is, the first shutter 37 becomes movable.

In the state shown in part (b) of FIG. 16, when the toner cartridge E is rotated relative to the developing unit D, as mentioned above, the claw portion 45 is engaged with the hole portion 37*a* so that the first shutter 37 can move to the open position.

In addition, when the toner cartridge E is removed from the developing unit D, the claw portion 61*a* advances into the hole portion 37*a* in interrelation with the operation of retracting the projection portion 45 from the hole portion 37*a* to lock the first shutter 37 (part (a) of FIG. 16).

In the present modified example described above, the projection 45 of the toner cartridge E serves as a releasing projection for releasing the lock by the lock arm 61.

SUMMARY

In this embodiment, the second shutter 53 is constituted to be rotatable around the container 47 (container frame 47*a*). By this, the second shutter 53 can be opened and closed by an operation (rotating operation) in which the toner cartridge E rotates relative to the developing unit D (receiving device). By opening and closing the second shutter 53 with rotating operation of the toner cartridge E, there is provided an advantage that the space (space) necessary for opening and closing the second shutter 53 can be reduced as compared with the case where the second shutter 53 is opened and closed by linear movement of the toner cartridge E.

That is, when the toner cartridge E rotates relative to the developing unit D, the toner cartridge E changes only the attitude thereof, and the center (rotation axis S) of the toner cartridge E hardly moves relative to the developing unit D. That is, in the opening and closing operation of the second shutter 53, the area occupied by the toner cartridge E in the developing unit D hardly changes. As a result, it is unnecessary to provide a large space for the developing unit D in order to open and close the second shutter 53. That is, by employing the toner cartridge E as in this embodiment, the receiving apparatus (developing unit D) for receiving the toner cartridge E and the image forming apparatus provided with the receiving apparatus are downsized.

INDUSTRIAL APPLICABILITY

According to the present invention, a toner cartridge for forming an electrophotographic image and a toner supply mechanism are provided.

SYMBOLS

16: Photosensitive drum (image bearing member)
17: Charging roller
19: Cleaning blade
24: Developing roller (developer carrying member)
25: Developing blade
27: First toner feeding means
28: First toner containing portion (developer accommodating portion)
29: First opening
30: Second opening (containing body opening, receiving port, receiving opening)
31: Developing chamber
32: First sealed seal
34: First shutter guide portion
35: Frame
35*a*: Abutted portion
35*d*: Insertion guide portion
36*a*: abutted portion
36*d*: Insertion guide portion
37: First shutter
37*a*: Hole
38: First drive transmission portion
42: Insertion guided portion (guided portion, toner cartridge side guide portion)
42*a*: Abutting portion

43: Insertion guided portion (guided portion, toner cartridge side guide portion)
43*a*: Abutting portion
44: Operating portion
45: Projection (container side engaging portion, opening/closing member moving portion, container side projection)
46: Second toner feeding member
47: Container
47*a*: Container frame
47*a*1: Side wall
47*a*2: Side wall
47*t*: Second toner container
48: Second drive transmission portion
49: Third opening (container opening, discharge opening, discharge opening)
53: Second shutter
53*c*: First abutting portion
53*m*: Shutter body
53*x*: Second abutting portion
53*y*: Extension part
54: Second sealed seal
58: Communication part
A: Image forming apparatus
C: Drum unit
D: Developing unit
E: Toner cartridge
F: Inserting direction
T: Toner

What is claimed is:

1. A toner cartridge comprising:

(1) a container including an accommodating portion for accommodating toner, and a discharge opening for discharging the toner from the accommodating portion;

(2) an open/close member movable relative to the container between a closed position for causing the closing portion to close the discharge opening and an open position for causing the closing portion to open the discharge opening, wherein the open/close member includes a leading end portion and a trailing end portion which are on downstream and upstream sides of the open/close member with respect to a closing direction in which the open/close member moves to close the discharge opening, respectively, wherein the open/close member extends from the leading end portion to the trailing end portion in a range exceeding 180° of a circumference of the container, as the toner cartridge is seen in the longitudinal direction of the container, and wherein the open/close member is provided with an engaging portion adjacent to the trailing end portion.

2. A toner cartridge according to claim 1, wherein the open/close member is movable between the closed position and the open position by rotating around a circumference of the container.

3. A toner cartridge according to claim 1, wherein the container has a substantially cylindrical shape.

4. A toner cartridge according to claim 1, wherein the open/close member is provided with an extended portion extending from the closing portion toward an upstream side in the closing direction, and wherein the engaging portion is provided on the open/close member.

5. A toner cartridge according to claim 4, wherein the open/close member is provided with a plurality of such extended portions each of which is provided with the engaging portion.

6. A toner cartridge according to claim 1, wherein the engaging portion is provided with a projection projecting in a direction away from the container.

7. A toner cartridge according to claim 1, wherein the open/close member is provided with a second engaging portion adjacent to the leading end portion.

8. A toner cartridge according to claim 7, wherein the second engaging portion includes a projection projecting in a direction away from the container.

9. A toner cartridge according to claim 1, wherein the container is provided with two projections arranged along a longitudinal direction of the container, and wherein, when the open/close member moves from the open position to the closed position, the leading end portion approaches to the two projections.

10. A toner cartridge according to claim 1, wherein as the two projections and the discharge opening project onto an imaginary line extending in the longitudinal direction of the container, at least a part of a projection area of the discharge opening is between projection areas of the two projections.

11. A toner cartridge according to claim 1, wherein as the two projections and the discharge opening project onto an imaginary line extending in the longitudinal direction of the container, an entirety of a projection area of the discharge opening is between projection areas of the two projections.

12. A toner cartridge according to claim 1, further comprising a drive input gear for receiving a driving force.

13. A toner cartridge according to claim 12, wherein the engaging portion approaches to an axis of the drive input gear by movement of the open/close member from the closed position to the open position.

14. A toner cartridge according to claim 12, further comprising a feeding member for feeding the toner toward the discharge opening by the driving force received by the drive input gear.

15. A toner cartridge according to claim 12, further comprising a transmission gear for transmitting the driving force from the drive input gear toward the feeding member.

16. A toner cartridge according to claim 1, wherein the open/close member extends from the leading end portion to the trailing end portion in a range of not less than 230° and not more than 270° of a circumference of the container, as the toner cartridge is seen in the longitudinal direction of the container.

* * * * *